US007110691B2

(12) United States Patent
Saida

(10) Patent No.: US 7,110,691 B2
(45) Date of Patent: Sep. 19, 2006

(54) IMAGE FORMING APPARATUS

(75) Inventor: Yukihiro Saida, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/854,715

(22) Filed: May 27, 2004

(65) Prior Publication Data

US 2004/0240903 A1 Dec. 2, 2004

(30) Foreign Application Priority Data

May 30, 2003 (JP) ..... 2003-155575

(51) Int. Cl.
*G03G 15/20* (2006.01)

(52) U.S. Cl. ..... 399/69; 219/216; 399/82; 399/85

(58) Field of Classification Search ..... 219/216; 399/67, 68, 69, 70, 81, 82, 83, 85, 388, 389, 399/396, 397, 400

See application file for complete search history.

(56) References Cited

U.S. PATENT DOCUMENTS 6,148,163 A * 11/2000 Ito ..... 399/67
6,751,425 B1 * 6/2004 Fujimori et al. ..... 399/69

FOREIGN PATENT DOCUMENTS

JP 2004-45698 2/2004

* cited by examiner

*Primary Examiner*—Hoang Ngo
(74) *Attorney, Agent, or Firm*—Takeuchi&Kubotera,LLP

(57) ABSTRACT

An image forming apparatus has a plurality of image forming units (R1–R4) for forming toner images, a fixing unit (63) for fixing the tone image to a medium, and a temperature control unit (122) for determining if each image forming unit is set and changing the set temperature of the fixing unit based on the determination. If a predetermined image forming unit is not used, a temperature can be set for the fixing unit so that the warming-up time can be shortened in the stand-by state. As a result, the image forming speed and through-put can be improved.

16 Claims, 27 Drawing Sheets

IMAGE FORMING APPARATUS

BACKGROUND OF THE INVENTION

1. Field of the Invention

The present invention relates to image forming apparatus.

2. Description of the Related Art

Image forming apparatus, such as electro-photographic printers, copiers, and facsimiles, are well known. An image forming apparatus has a medium transporting unit and a plurality of image forming units. The medium transporting unit transports a medium to the image forming units, which are disposed along the medium transport passage. Each image forming unit has a printing process cartridge, an exposing section, and a transfer section to form a toner image. The transfer section transfers to a medium the toner image that is made in the printing process cartridge. The printing process cartridge is detachable from the image forming unit. It has a charging section, a photosensitive body, a developing section, a cleaning section, a toner cartridge, and a drive transmitting section.

The drive transmitting section transmits power for driving the charging, photosensitive, and developing sections. The charging section charges the photosensitive body. The exposing section illuminates the surface of the charged photosensitive body to form an electrostatic latent image on the photosensitive surface according to the printing data. The developing section adheres a toner to the latent image on the photosensitive body to make a toner image that is visible. The cleaning section scrapes off the remaining toner from the photosensitive body. The toner cartridge, which is detachable from the printing process cartridge, supplies the developing section with toner.

The developing section is provided with a developing roller and a toner supply roller. The developing roller is pressed against the surface of the photosensitive body to adhere toner to the latent image on the photosensitive body. The transfer section transfers the toner image onto a recording medium from the photosensitive body. The fixing section has a heat roller and a heater for heating the heat roller to fix the toner image on the recording medium. Also, it has a pressure roller for pressing the heat roller against the recording medium. The heater of the fixing section produces heat at the time of printing and the recording medium and the toner thereon absorb the heat, keeping the image forming unit at a relatively low temperature.

In order to speed up the image forming process, the heater is made to produce heat at a time when no printing is made, when the recording medium and the toner thereon do not absorb the heat. Consequently, a large amount of heat is conducted from the fixing section to the image forming unit, raising its temperature very high. As a result, the toner is melted and deformed to adhere to the image forming unit. The thermally deformed toner degrades the quality of an image formed on the recording medium.

Thus, the temperature of the fixing heater is lowered when no printing is made so that a small amount of heat is conducted to heat the image forming unit, keeping its temperature at a low level. Consequently, the toner is kept normal in the image forming unit. However, the subsequent image forming process takes a long time because it takes a long time to bring the fixing unit from the low temperature to the high temperature, reducing the image forming speed and through-put.

SUMMARY OF THE INVENTION

Accordingly, it is an object of the invention to provide an image forming apparatus having a high image forming speed and through-put.

According to the invention there is provided an Image forming apparatus including at least one image forming unit for forming a toner image on an image carrying member, a transfer unit opposed to the image carrying member for transferring the toner image to a recording medium, a fixing unit for fixing the toner image on the recording medium, and a temperature control unit for determining if the image forming unit is set and changes the temperature set for the fixing unit based on the determination.

DESCRIPTION OF THE PREFERRED EMBODIMENTS

Embodiments of the invention will now be described below with respect to the accompanying drawings, in which an electrophotographic tandem-type printer is used as an image forming apparatus.

Figure 1:
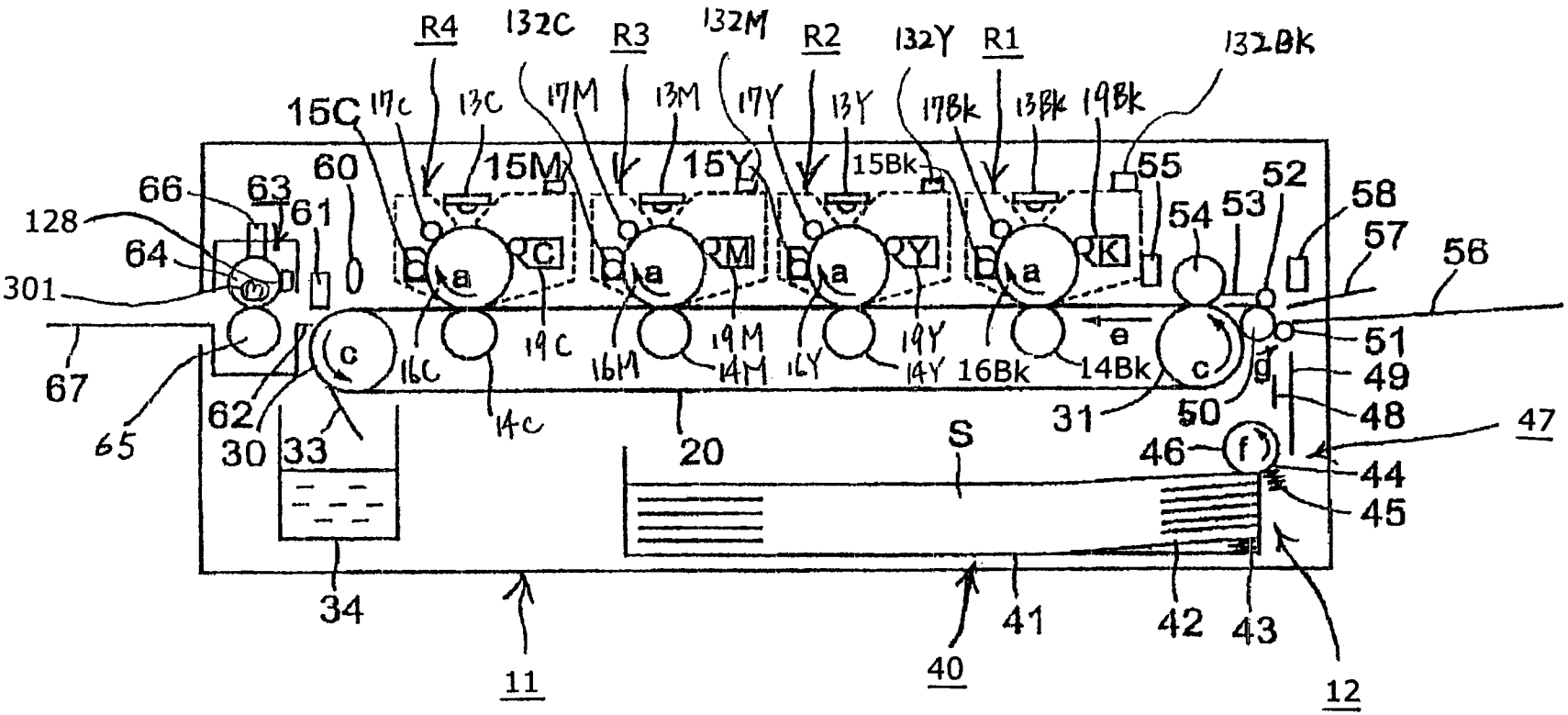
FIG. 1 is a side view of a printer according to the first embodiment.

In FIG. 1, the printer 11 includes four image forming units R1–R4 disposed along the transfer of a recording medium S from the input or paper-feeding side to output or paper-discharging side. The image forming unit R1 includes a printing mechanism for transfer of a black toner image to the recording medium S. Similarly, each image forming unit R2, R3, or R4 includes a printing mechanism for transferring to the recording medium S a yellow, magenta, or cyan toner image, respectively.

Each of the image forming units R1–R4 includes an image carrying member or photosensitive drum 16Bk, 16Y, 16M, or 16C rotatable in the direction of arrow (a), a primary charging roller 17Bk, 17Y, 17M, or 17C for charging uniformly the surface of the photosensitive drum 16Bk, 16Y, 16M, or 16C, a developing unit 19Bk, 19Y, 19M, or 19C for adhering a developing agent or black, yellow, magenta or cyan toner to the static latent image on the photosensitive drum 16Bk, 16Y, 16M, or 16C to form a toner image, and a cleaning unit 15Bk, 15Y, 15M, or 15C for scraping a remaining toner from the photosensitive drum 16Bk, 16Y, 16M, or 16C after the image transfer. Each of the cleaning units 15Bk, 15Y, 15M, and 15C includes a screw shaft for discharging the scraped toner into a waste toner tank (not shown).

Exposure units or LED heads 13Bk, 13Y, 13M, and 13C are disposed above the image forming units R1–R4 so as to face the respective photosensitive drums 16Bk, 16Y, 16M, and 16C to expose the photosensitive surface of the photosensitive drums 16Bk, 16Y, 16M, and 16C according to respective black, yellow, magenta, and cyan image signals, forming electrostatic latent images thereon. Transfer units or rollers 14Bk, 14Y, 14M, and 14C are disposed below the respective image forming units R1–R4 so as to face the photosensitive drums 16Bk, 16Y, 16M, and 16C via a transport belt 20 and transfer the toner images to the recording medium S. Alternatively, the LED heads 13Bk, 13Y, 13M, and 13C may be replaced by other exposure devices, such as laser devices or liquid crystal shatters.

The image forming units R1–R4 are detachable from the body of the printer 11. The developing units 19Bk, 19Y, 19M, and 19C are detachable from the body of the image forming units R1–R4, which are driven by respective motors independently.

The transport belt 20 is an endless belt made of a highly resistant, semiconductive plastic film and runs between a driving roller 30 and a driven roller 31. The resistance value of the transport belt 20 is set in such a range that the recording medium S is adsorbed to the transport belt 20 by electrostatic force and, when the recording medium S is separated from the transport belt 20, the remaining electrostatic charge is discharged automatically. The driving roller 30 is coupled to a transport motor (not shown) so that when the motor is started, it rotates in the direction of arrow (c) to move the transport belt 20.

The upper portion of the transport belt 20 runs between the photosensitive drums 16Bk, 16Y, 16M, and 16C and the corresponding transfer rollers 14Bk, 14Y, 14M, and 14C such that both the photosensitive drums 16Bk, 16T, 16M, and 16C and the transfer roller 14Bk, 14Y, 14M, and 14C are in contact with the transfer belt 20.

A cleaning blade 33 is pressed against the driving roller 30 via the transport belt 20. It is made of a flexible rubber or plastic material. When the transport belt 20 travels, it scrapes the remaining toner from the transport belt 20 into the waste toner tank 34.

A paper feeding mechanism 12 is disposed at the lower right corner of the printer 11. It includes a recording medium container or paper holding cassette 40, a hopping mechanism 47, a transport roller 50, and the first and second registry rollers 51 and 52. The paper holding cassette 40 includes a recording medium container 41, a push-up plate 42, and a pressure member 43. The hopping mechanism 47 is disposed at the outlet of the recording medium container 41 and includes a valve member 44, a spring member 45, and a feeding roller 46.

When the feeding roller 46 is rotated by driving a hopping motor (not shown), a recording medium S is taken out from the recording medium container 41 and guided by guides 48 and 49 to the first and second registry rollers 51 and 52 that are disposed in contact with the transport roller 50. There are provided a medium guide 53 and an adsorbing roller 54 that is pressed against the driven roller 31. The recording medium S from the registry rollers 51 and 52 is guided by the medium guide 53 and charged by the adsorbing roller 54 so that it is adsorbed on the upper face of the transport belt 20. It is noted that even if adsorbing roller 54 is omitted, it is possible to transport the recording medium S.

A recording medium detecting section or photo-sensor 55 is disposed between the adsorbing roller 54 and the first image forming unit R1 to detect the front end of a recording medium S. A manual insertion tray 56 allows the operator to manually insert a recording medium S into a space between the manual insertion tray 56 and the guide 57. A recording medium detector or photo-sensor 58 detects the manually inserted recording medium S, which is sent into a space between the adsorbing roller 54 and the transport belt 20 by the transport roller 50 and the second registry roller 52.

The paper feeding mechanism 12 operates as follows. A recording medium S in the recording medium container 41 is pushed up by the pressure member 34 and the push-up plate 42 and pressed against the feeding roller 46, against which the valve member 44 is pressed by the spring 45. Consequently, when the feeding roller 46 rotates in the direction of arrow (f), the recording medium S is taken out by the valve member 44 sheet by sheet from the recording medium container 41 and guided by the guides 48 and 49 to a space between the transport roller 50 and the first registry roller 51.

Then, a secondary feeding motor (not shown) is started to rotate the transport roller 50 in the direction of arrow (g) so that the recording medium S is sent from the second registry roller 52 and guided by the medium guide 53 to a space between the adsorbing roller 54 and the transport belt 20. The driven roller 31 pressed against the adsorbing roller 54 is grounded so that the recording medium S is adsorbed to the transport belt 20. Then, the recording medium S is transported at a transport speed according to the rotation speed of the driving roller 30.

A discharge device 60 is disposed above the driving roller 30 for the transport belt 20. It is spaced from the transport belt 20 by a predetermined distance. It discharges the recording medium S that has been adsorbed to and transported by the transport belt 20. The discharged recording medium S is released from the adsorption to the transport belt 20 for facilitating separation therefrom. A recording medium detector or photo-sensor 61 is disposed on the down-stream side of the discharging device 60 to detect the rear end of the recording medium S.

A paper guide 62 is disposed on the down-stream side of the photo-sensor 61. A fixing unit or fixer 63 is disposed on the down-stream side of the paper guide 62 to fix the toner images on the recording medium S that has been transported by the transport belt 20. For this purpose, the fixer 63 has a heat roller for heating the toner. The heat roller 64 has a heater 301 therein. A pressure roller 65 is provided in the fixer 63 to press the recording medium S against the heat roller 64. The pressure roller 65 rotates in contact with the heat roller 64.

A cleaning pad 66 of felt is disposed at the upper portion of the fixer 63. The cleaning pad 66 is pressed against the heat roller 64 to remove the toner that has adhered to the surface of the heat roller 64. A discharge port of the printer 11 is disposed on the down-stream side of the fixer 63. A discharge stacker 67 is disposed outside of the discharge port to hold the discharged recording medium S on which printing has been made.

The fixer 63 is kept at a predetermined temperature. The heat of the fixer 63 is transmitted through air by radiation and conduction via air. The heat from the fixer 63 is discharged via the case of the printer 11. The case of the printer 11 is cooled by the outside air, which in turn cools the air inside the printer 11, thus keeping the temperature inside the printer from rising above a certain level.

The recording medium S and the toner thereon are housed in a place having a temperature lower than that of the vicinity of the fixer 63. When printing is made in the printer, the recording medium S and the toner thereon are transported from the low-temperature place to the high-temperature place in the vicinity of the fixer 63. The-temperature recording medium S and the toner thereon absorbs the heat from the air inside the case so that the temperature inside the case can be kept constant even if the temperature of the fixer 63 during printing is higher than that of the stand-by mode.

The air temperature close to the printer walls is lower than the temperature in the vicinity of the fixer 63, which is a heat source, and the influence of heat radiation from the fixer 63 decreases with the increasing distance from the fixer 63 so that the temperature inside the printer case decreases as the distance from the fixer 63 increases. When a predetermined heat is transmitted, the toners 21 on the respective image forming units R1–R4 are fused. Consequently, it is necessary to control the temperature of the image forming units R1–R4 as the temperature inside the printer case rises. Thus, it is possible to set the stand-by temperature of the fixer 63 at a high level in view of the distance between the image forming unit and the fixer 63.

Figure 2:
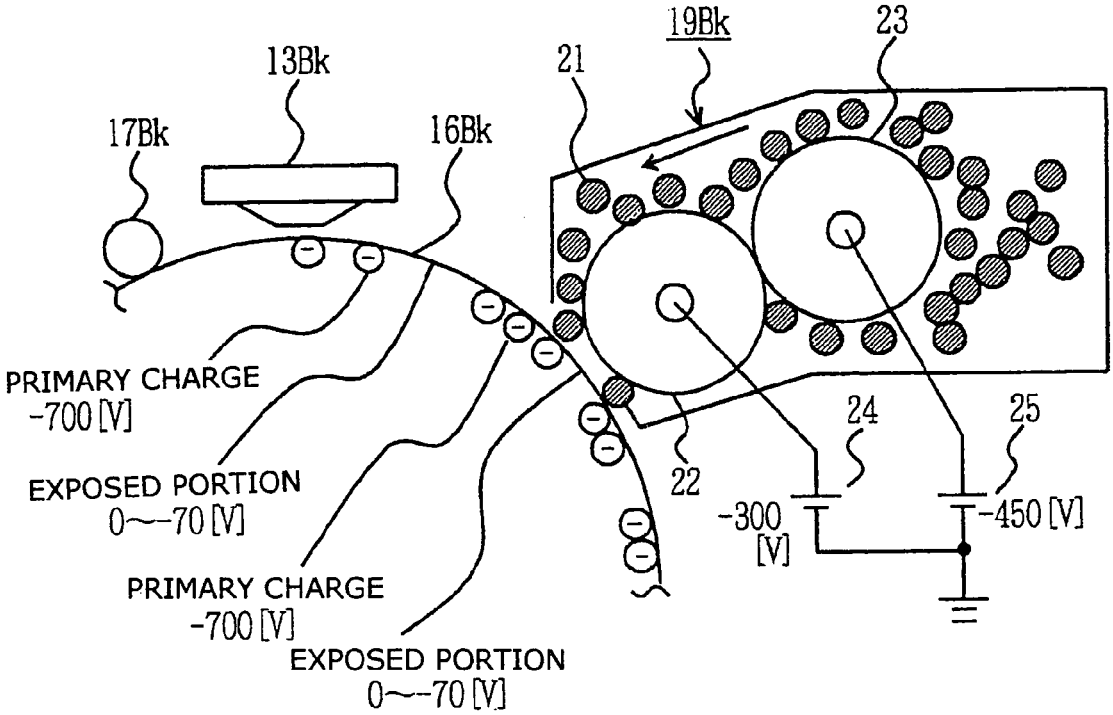
FIG. 2 is a side view of the essential part of an image forming unit according to the first embodiment.

The image forming process in the image forming units R1–R4 will be described below with reference to FIG. 2. Since the image forming units R1–R4 are identical so that only that of the image forming unit R1 will be described.

A charging roller 17Bk is opposed to the photosensitive drum 16Bk. Similarly, the LED head 13Bk and the developing unit 19Bk are opposed to the photosensitive drum 16Bk. The developing unit 19Bk is filled with a toner 21. A developing agent carrying member or developing roller 22 and a developing agent supply member or toner supply roller 23 are disposed inside the developing unit 19Bk, respectively.

Figure 3:
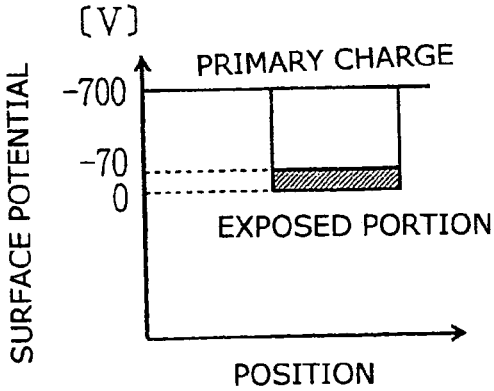
FIG. 3 is a diagram showing the surface potential of a photosensitive drum according to the first embodiment.

The photosensitive drum 16Bk is rotated by driving a developing/transfer motor (not shown). As the photosensitive drum 16Bk rotates, a charging voltage of negative polarity is applied to the charging roller 17Bk from a high voltage source (not shown) to form a primary charged portion on the photosensitive drum 16Bk that is charged to a certain surface potential (approx. −700 V). Then, the photosensitive drum 16Bk is exposed to light of the LED head 13Bk. Consequently, the surface potential of the exposed portion on the photosensitive drum 16Bk becomes 0 to −70 V, forming an electrostatic image. See FIG. 3.

As described above, the surface potential of the primary charged portion on the photosensitive drum 16Bk is approx. −700 V but the surface potential of the exposed portion is 0 to −70 V. A developing high voltage supply 24 is connected to the developing unit 19Bk to apply a developing bias voltage of −300 V to the developing roller 23. Also, a toner supply high voltage supply 25 is connected to the developing unit 19Bk to apply a voltage of −450 V to the toner supply roller 23. The toner supply roller 23 is made of a sponge roller and supplies the developing blade (not shown) with an appropriate amount of toner 21.

Figure 4:
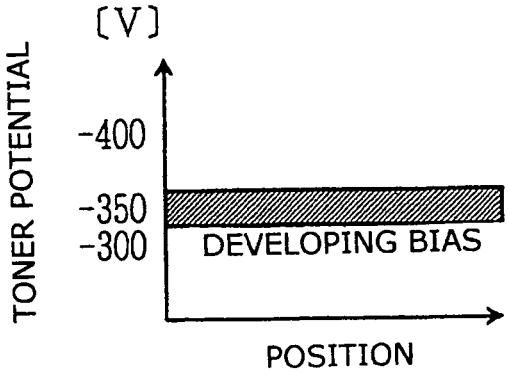
FIG. 4 is a diagram showing the toner potential according to the first embodiment.

When the voltage of −300 V is applied to the developing roller 22, the toner 21 is supplied to the developing roller 22 from the toner supply roller 23 so as to adhere to the developing roller 22 for developing the electrostatic latent image on the photosensitive drum 16Bk. The potential of the charged toner 21 is approx. −50 to −100 V so that the potential of the developing toner 21 on the developing roller 22 is −350 to −400 V. See FIG. 4.

The surface potential of the unexposed portion on the photosensitive drum 16Bk remains −700 V. Consequently, the toner 21 on the developing roller 22 is attracted to the exposed portion of the photosensitive drum 16Bk to form a toner image. The potential difference between the unexposed portion of the photosensitive drum 16Bk (−700 V) and the toner 21 (−350 to −400 V) is at least −300 V so that the toner 21 on the developing roller 22 is not attracted to the unexposed portion of the drum 16Bk.

Figure 5:
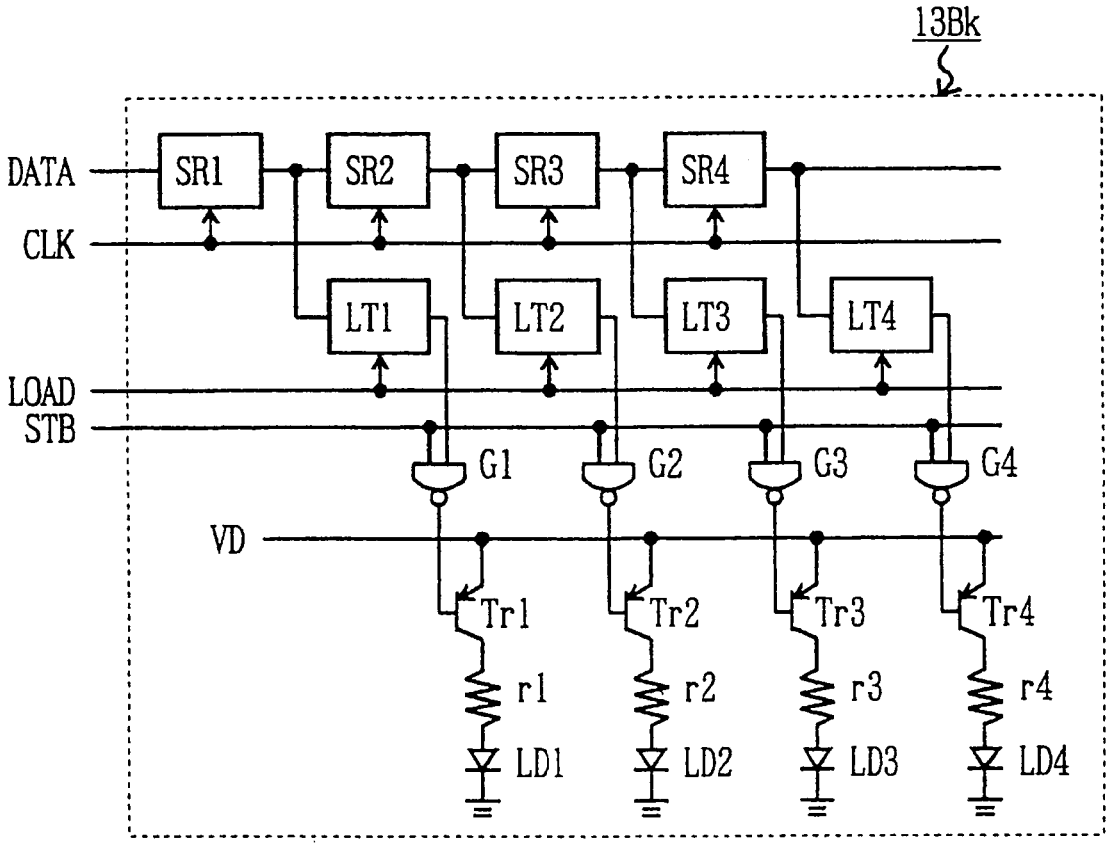
FIG. 5 is a block diagram of an LED head driving circuit according to the first embodiment.

The LED head 13Bk will be described below with reference to FIG. 5. A printing data signal DATA is input to the LED head 13Bk together with a clock signal CLK. For example, in the image forming apparatus having the LED head 13Bk with an arrangement density of 300 dpi, the printing data signal DATA of 2560 bits is input to the shift registers SR1, SR2, . . . , and SR2560 in sequence.

When a latch signal LOAD is input to the LED head 13Bk, the bit data is output to the respective latches LT1, LT2, . . . , and LT2560 from the shift registers SR1, SR2, and SR2560 for latching. Then, the light emitting element LD1, LD2, . . . , or LD2560 corresponding to the bit data that the printing data signal DATA is at a high level is turned on in synchronism with the input of a print driving signal (strobe signal) STB into the LED head 13Bk. There are provided gates G1, G2, . . . , and G2560, switching elements Tr1, Tr2, . . . , and Tr2560, protective resistors r1, r2, . . . , and r2560, and a power source VD.

The LED head 13Bk has an exposure function. It includes a substrate having an LED array of light emitting elements LD1, LD2, . . . , and LD2560 and a drive IC for driving the LED array corresponding to the image signal, and a light collecting device or rod lens array for focusing light from the light emitting elements LD1, LD2, . . . , and LD2560 to the photosensitive drum 16Bk. The LED array is turned on corresponding to the black image signal to expose the photosensitive drum 16Bk (FIG. 1). Similarly, a yellow image signal is input to the LED head 13Y, a magenta image signal is input to the LEFD head 13M, and a cyan image signal is input to the LED head 13C.

Figure 6:
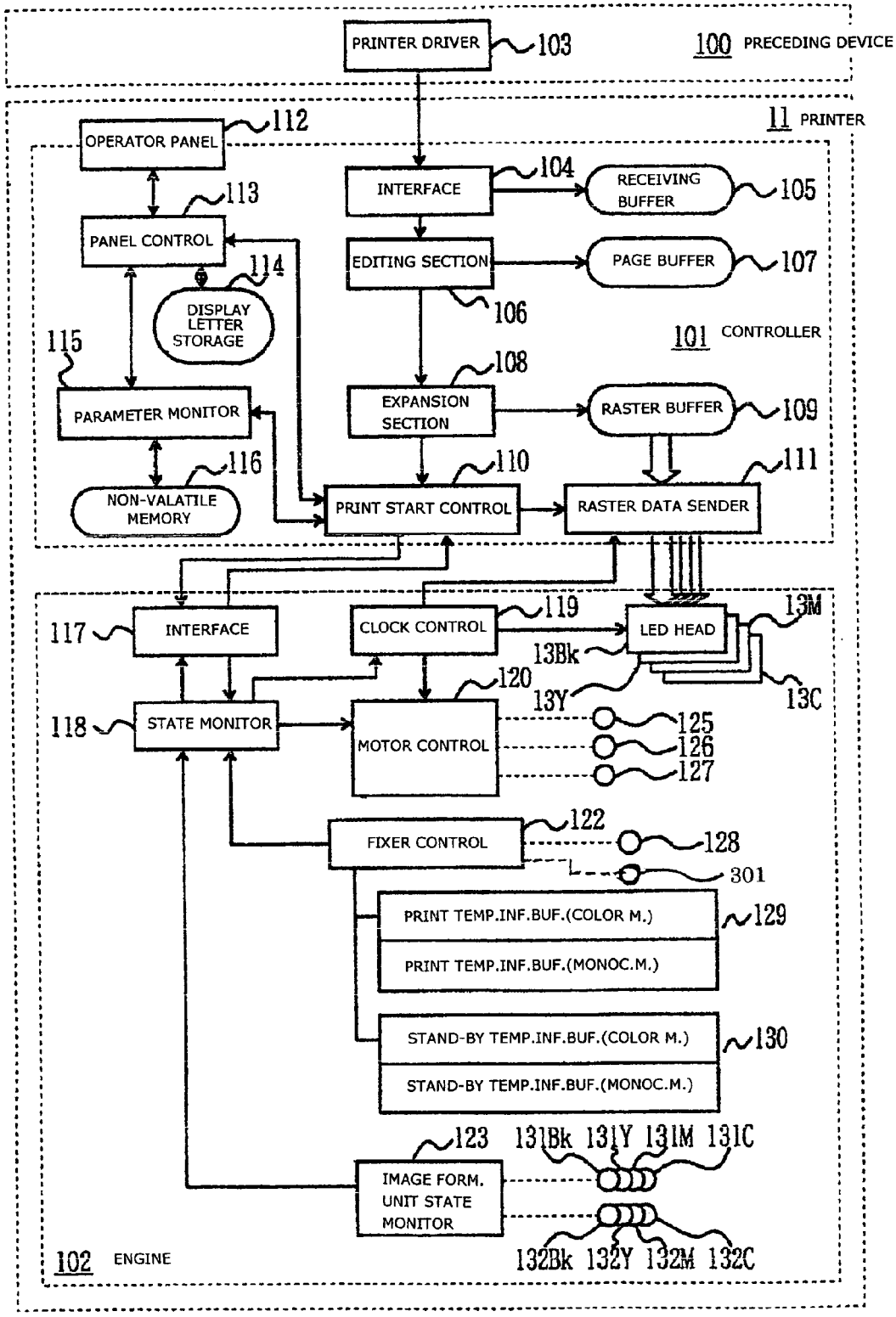
FIG. 6 is a block diagram of a printer control unit according to the first embodiment.

The control unit of the printer 11 will be described below with reference to FIG. 6. The printer 11 includes a controller 101 for controlling the image information and a printing engine 102. The printer 11 is connectable to a prepositional device 100, such as workstation or personal computer, that has a printer driver 103 for sending to the printer the image information or printing data. The controller 101 includes an interface 104 for receiving the printing data from the printer driver 103, a receiving buffer 105 for recording the printing data received by the interface 104, and an editor 106 for editing the printing data recorded in the receiving buffer 105 into a page descriptor or a page of intermediate data or page data. Also, the controller 101 includes a print start controller 110 for sending a control signal to the printing engine 102 in response to the hereinafter described expansion section 108, a page buffer 107 for recording the page data transformed by the editor 106, the expansion or explosion section 108 for reading the page data from the page buffer 107 to expand or explode it to an image data, a raster buffer 109 for recording the image data expanded by the expansion section 108 as a raster data, and a raster data sending unit or section 111 for reading the raster data from the raster buffer 109 and transferring the image signal to the LED head.

The raster data sending section 111 sends the black image signal to the LED head 13Bk. Similarly, it sends the yellow, magenta, and cyan image signals to the LED heads 13Y, 13M, and 13C, respectively. The controller 101 has an operator panel 112 which display the state of the printer 11. The operator panel 112 has an input section for the operator input. The controller 101 includes a panel control unit or section 113 for controlling the operator panel 112, a display character line recorder 114 as a data base for a character line indicating the state of the printer 11, a parameter monitor 115 for monitoring the contents of printer setting that is changed by the operator via the operator panel 112, and a recording section or non-volatile memory 116 for recording the contents of the changed setting.

The printer engine or engine section 102 includes an interface for communication between the controller 101 and the engine section 102, a state monitor 118 for monitoring the states of motors, sensors, etc. The engine section 102 includes a clock controller 119 for sending clocks to the LED heads 13Bk, 13Y, 13M, and 13C upon start by the state monitor 118, a hopping motor 125 for driving the paper feeding roller 46, a transport motor 126 for driving the transport belt 20, a motor controlling unit or section 120 for controlling an up/down motor 127 that selectively moves the image forming units R1–R4 to either the upper retreat position or the lower operation position.

Also, the engine section 120 includes a printing temperature buffer 129 that holding the information about different print temperatures for the color mode for color printing and the monochrome mode for black-and-white printing, a stand-by temperature buffer 130 that holds the different stand-by temperature information for the color and monochrome modes, a temperature detector or temperature sensor 128 on the fixer 63, a fixer controlling section 122 for monitoring the temperature sensor 128 based on the printing and stand-by temperature information in the printing and stand-by temperature buffers 128 and 130 to control the temperature of the fixer 63. The fixer controlling section 122 turns on/off a heater 301 inside the heat roller 64 to control the temperature of the fixer 63.

The engine section 102 also includes toner sensors 131Bk, 131Y, 131M, and 131C for monitoring the remaining amount of black, yellow, magenta, and cyan toners, respectively, image forming unit detecting sensors 132Bk, 132Y, 132M, and 132C for detecting the presence or absence of the image forming units R1, R2, R3, and R4, respectively, an image forming unit monitor 123 for monitoring the states of the image forming units R1–R4 based on the detection results by the toner sensors 131Bk, 131Y, 131M, and 131C and the image forming section detecting sensors 132Bk, 132Y, 132M, and 132C. Each image forming unit detecting sensor 132Bk, 132Y, 132M, or 132C is a switch that sends out a signal having a level Lo to the image forming unit monitor 123 when it comes into contact with one of the image forming units R1, R2, R3, and R4.

The printing temperature information contains the printing temperature set for the fixer 63 in printing. The stand-by temperature information contains the temperature set for the fixer 63 in the stand-by state. The heat generated by the heater 301 of the fixer 63 is absorbed by the recording medium S and the toner 21. Consequently, if the printing temperature set to be equal to the fixing temperature, the temperature of the image forming units R1–R4 can be kept at a relatively low. In the stand-by state where no printing is made, the above heat is absorbed by neither the recording medium S nor the toner. Consequently, if the stand-by temperature is set to be equal to the fixing temperature, the temperature of the image forming units R1–R4 becomes high. For this reason, the stand-by temperature is set lower than the fixing temperature.

In the color mode, all the image forming units R1–R4 are set in the printer 11. Consequently, the image forming unit close to the fixer 63 tends to have a high temperature.

In the monochrome mode, the image forming units R2–R4 are removed from the printer 11. The image forming unit R1 is set at a position furthest from the fixer 63 so that its temperature does not tend to rise. Thus, the monochrome printing temperature and the stand-by temperature are set higher than the color mode printing temperature.

The printer 11 operates as follows. When the controller 101 receives a printing data from the preceding apparatus 100 via the interface 104, it records the printing data in the receiving buffer 105. The interface 104, which recognizes the reception of the printing data, sends the printing data to the editor 106. When the editor 106 receives the printing data, it edits the printing data to transform it into a page data and records a page of page data in the page buffer 107. After recording the page of page data in the page buffer 107, the editor 106 sends an expansion request to the expansion section 108.

Then, the expansion section 108 reads out the page data from the page buffer 107. It then expands the page data as an image data and records the image data in the raster buffer 109 as a raster data. It then sends a printing request to the printing start control section 110, which in turn sends a print preparation request to the engine section 102. The print starting control section 110 sends out a feed request of the recording medium S and stands by until the engine section 102 is ready to operate. When the printing start control section 110 recognizes that the engine section 102 is ready, it sends a printing request to the engine section 102. The printing start control section 110 sends a data transfer request to the raster data sending section 111.

Then, the raster data sending section 111 reads out the raster data line by line from the raster buffer 109. Then, it transfers the black image signal to the LED head 13Bk in synchronism with the clock from the clock control section 119 of the engine section 102. Similarly, it transfers the yellow, magenta, and cyan image signals to the LED heads 13Y, 13M, and 13C in synchronism with the clock from the clock control 119 of the engine section 102, respectively.

The engine section 102 performs printing operation as follows. First of all, the controller 101 sends a printing preparation request to the engine section 102, and the engine section 102 provides the fixer control 122 with an instruction for temperature control. The fixer control 122 then performs on-off control of the fixer 63 based on the temperature detected by the temperature sensor 128 so that the fixer 63 has the fixing temperature that is sufficient to fix. When the fixer 63 reaches the fixing temperature, the controller 101 sends a print preparation completion signal to the controller 101. When it receives a paper hopping request from the controller 101, the state monitor 118 sends an instruction to the motor control 120, which in turn drives the hopping motor 125 to feed the recording medium S. When a hopping sensor (not shown) detects the front end of the recording medium S, the state monitor 118 sends a hopping preparation completion notice to the controller 101. When it receives a printing request from the controller 101, the state monitor 118 drives the transfer motor 126 to send the fed recording medium S to the first and second registry rollers 51 and 52. Then, the state monitor 118 sends a clock sending request to the clock control section 119 at the time of LED illumination.

The monochrome printing will be described below with reference to FIGS. 7 and 8, wherein the same structural elements are given the same reference characters as those of the printer 11 in FIG. 1 and their description will be omitted.

Figure 7:
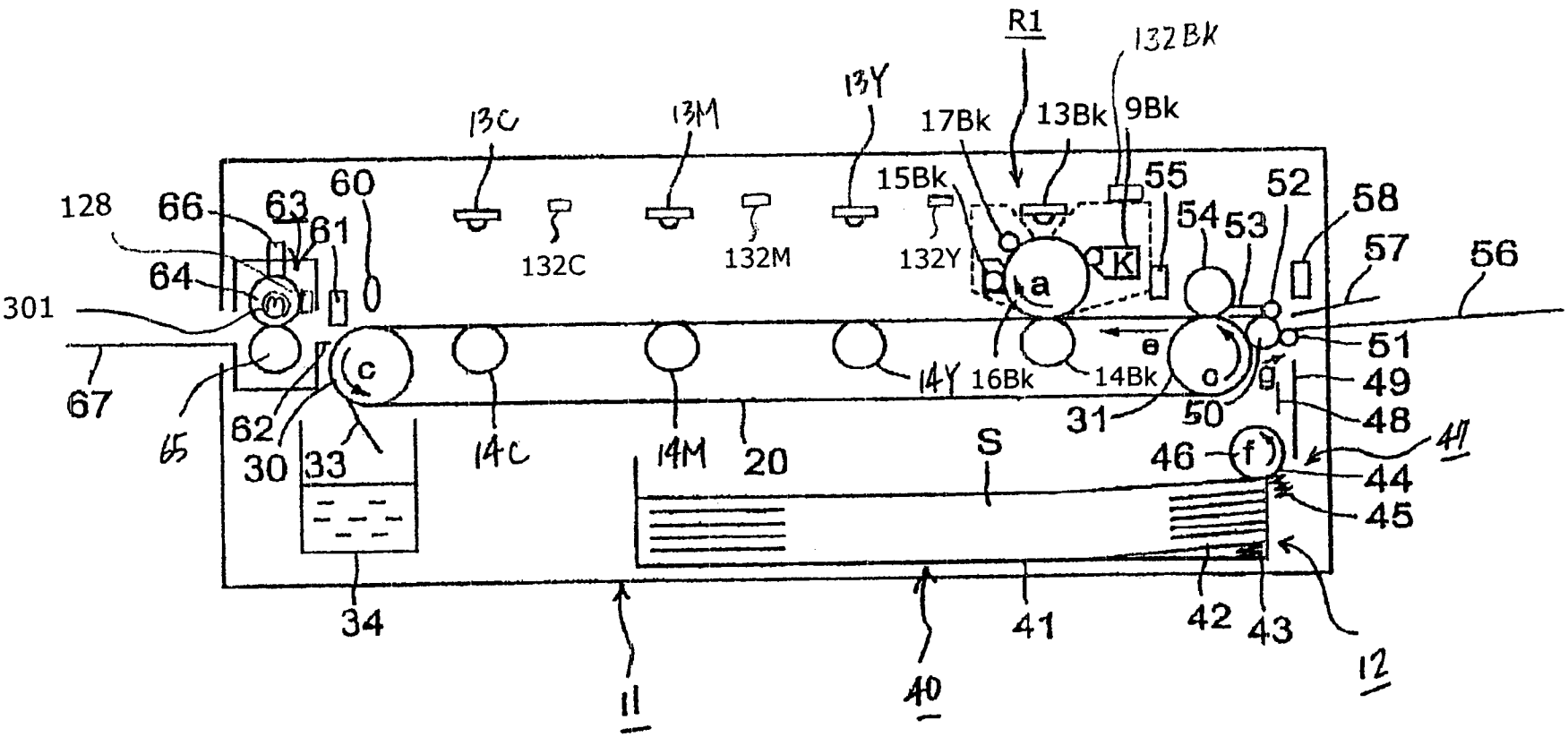
FIG. 7 is a side view of a printer in monochrome mode printing according to the first embodiment.
Figure 8:
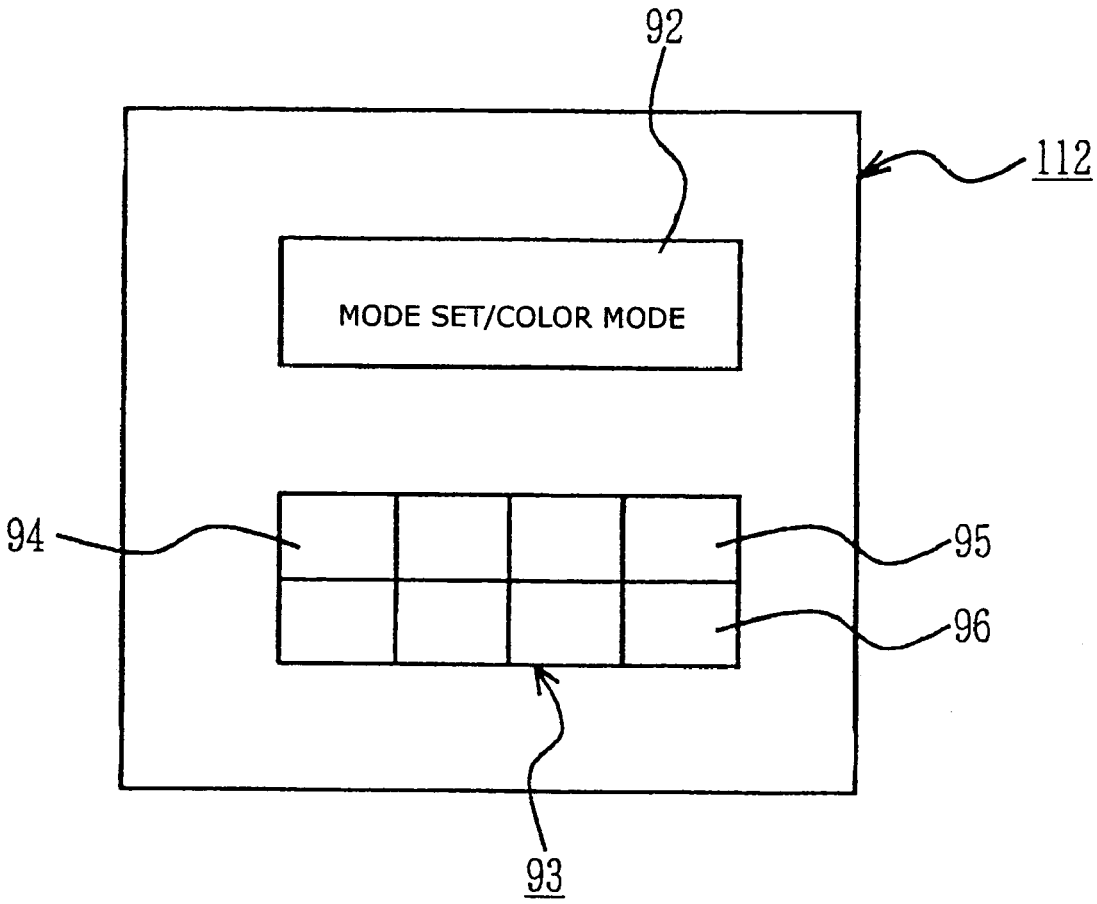
FIG. 8 is a plan view of an operator panel according to the first embodiment.

As shown in FIG. 7, the image forming units R2–R4 are removed in the initial state of the printer 11. The controller 101, however, does not perform an error process, with the image forming units R2–R4 removed, so that the printer 11 is able to print. A cover is attached to the printer 11 for opening/closing movement. By opening the cover it is possible to set or remove the image forming units R1–R4 from the printer 11. Also, the cover is opened when a paper jam is removed. The operator manipulates the operator panel 112 to designate the image forming unit to be used among the image forming units R1–R4. For example, the operator panel 112 includes the display section 92 and the operation section 93. See FIG. 8.

When the operator depress the setting key 94 on the operation section 93, one of the color and monochrome modes is selected and shown in the display section 92 as "mode setting/color mode" for example. When the operator intends to select the color mode and depresses the designation key 95, the color mode shown in the display section 92 is set up. When the operator depresses the switching key 96 instead of the designation key 95, "mode setting/monochrome mode" is shown in the display section 92. The information which image forming unit R1–R4 is used is sent to the parameter monitor 115 from the operator panel 112 via the panel control 113. The parameter monitor 115 then records the information in the non-volatile memory 116. Alternatively, it is possible to manipulate the operation section (not shown) of the preceding device 100 to designate the image forming unit to be used.

Figure 9:
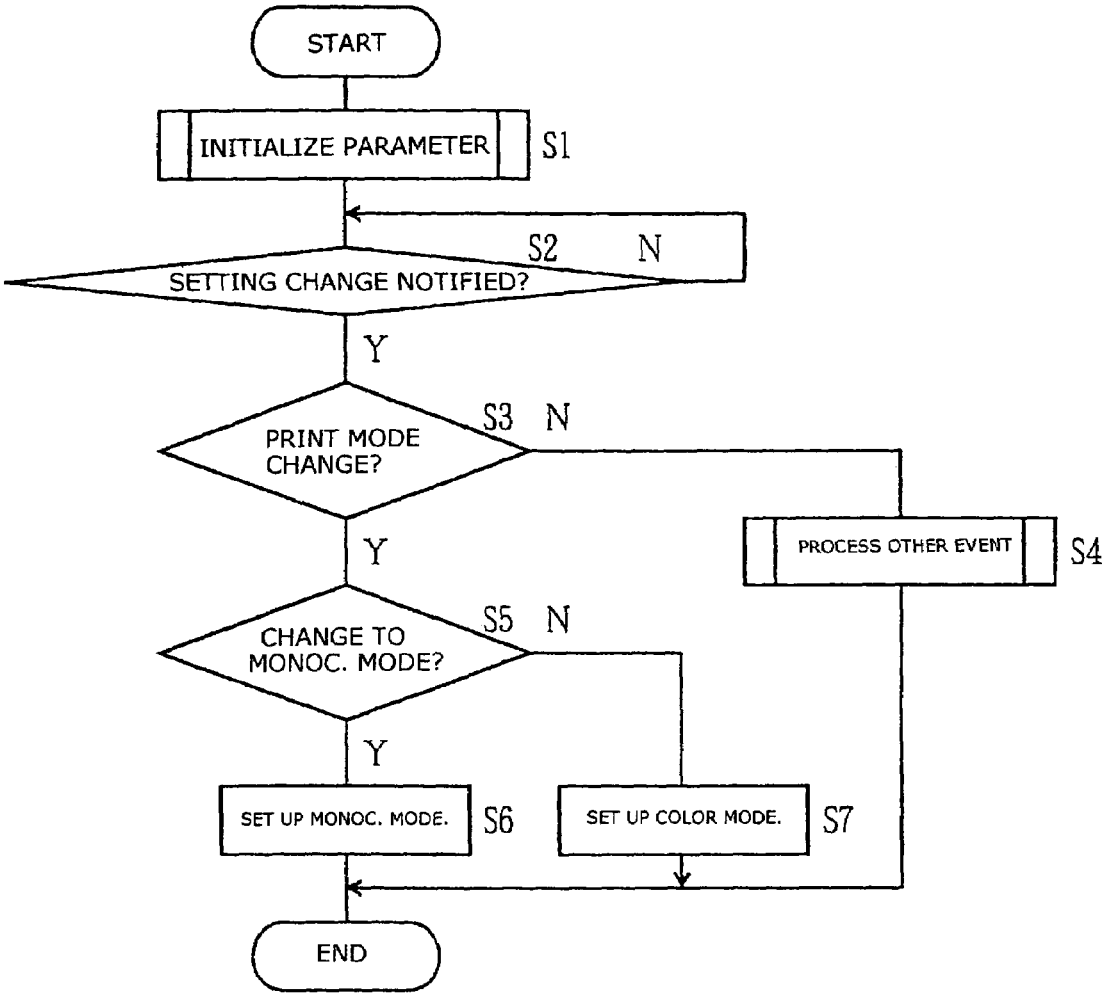
FIG. 9 is a flow chart showing a printing mode setting process according to the first embodiment.

The printing mode setting process in the controller 101 will be described below with reference to FIG. 9. When power is turned on, the printing mode setting unit reads out the previous printing mode setting from the non-volatile memory 116 (FIG. 6). Then, the parameter initialization section of the printing mode setting unit performs the parameter initialization process. Then, the printing mode setting device stands by for notification of change in the setting of the printer 11 (FIG. 1). Upon notification of the setting change, the printing mode determining section of the printing mode setting device performs the printing mode determining process.

When the printing mode determining section determines that the setting change is a change of the printing mode, it determines whether the printing mode change is a change to the monochrome mode. When the printing mode determining section determines that the setting change is not a change of the printing mode, the other event processing section of the printing mode setting device perform the corresponding event. When the change is a change to the monochrome mode, the mode setting section of the printing mode setting device performs a mode setting process to set the monochrome mode and records in the printing mode information recording area of the non-volatile memory 116 the printing mode information that the monochrome mode is set up. When the change is not to the monochrome mode, the mode setting section sets up the color mode and records in the printing mode information recording area the printing mode information that the color mode is set up in the printing mode information recording area.

Now, reference is made to the flow chart.

In Step S1, the parameter initialization is made.

In Step S2, if a change is notified, the process goes to Step S3.

In Step S3, whether the change is a change of the printing mode is determined. If it is the printing mode change, the process goes to Step S5. If it is not the change of the printing mode, the process goes to Step S4.

In Step S4, the other event processing is performed and the process is completed or terminated.

In Step S5, whether it is a change to the monochrome mode is determined. If it is the change to the monochrome mode, the process goes to Step S6. If it is not the change to the monochrome mode, the process goes to Step 7.

In Step S6, the monochrome mode is set up and the process is completed.

In Step S7, the color mode is set up and the process is completed or terminated.

Figure 10:
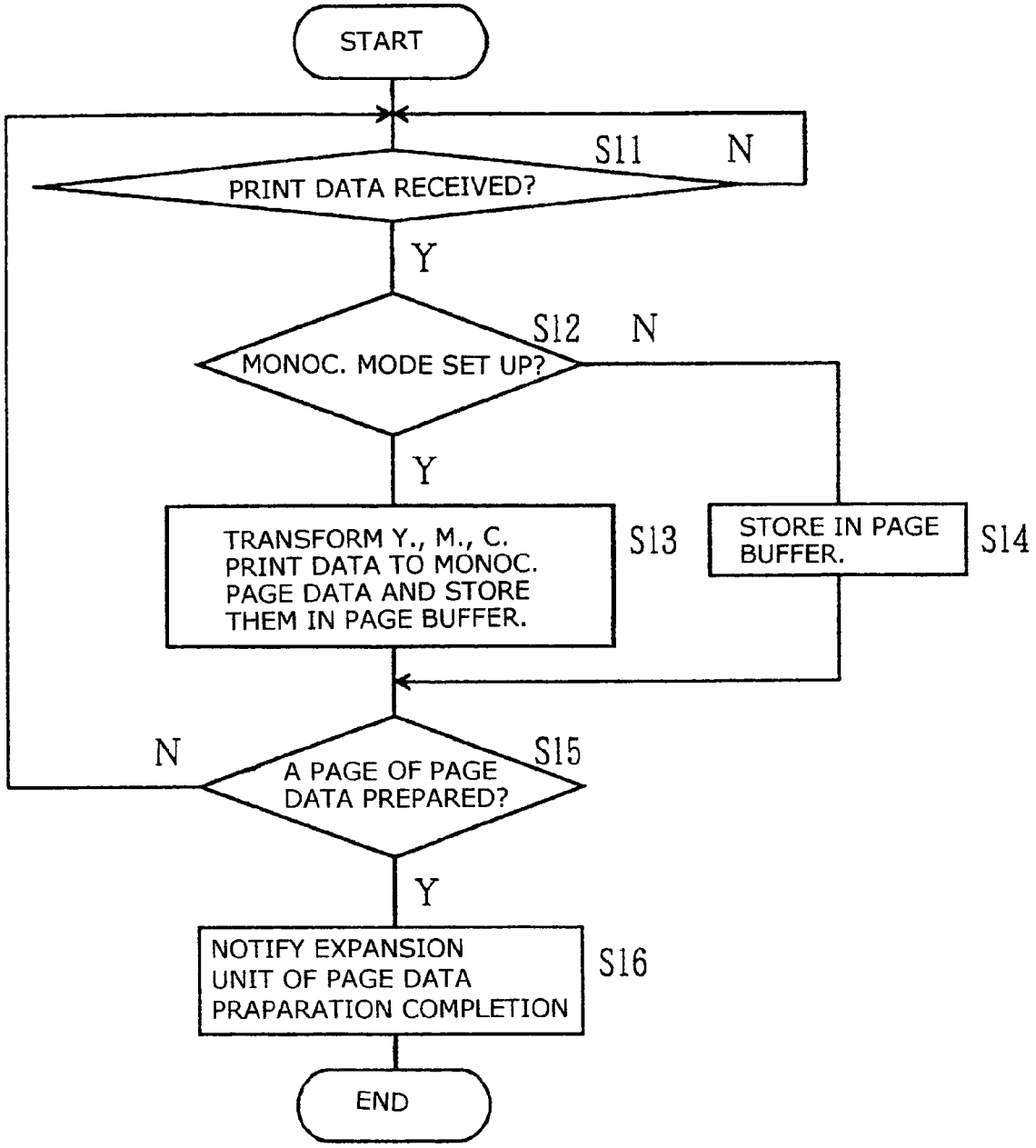
FIG. 10 is a flow chart showing an editing process according to the first embodiment.

The editing process will be described below with reference to FIG. 10. First, the editing unit checks with the receiving buffer 105 (FIG. 6) and stands by until the printing data is received. When the printing data is received, the editing unit reads out the above printing mode information and determines whether monochrome mode is set up. If the monochrome mode is set up, the editing unit transforms the yellow, magenta, and cyan printing data into the printing color data to be printed or monochrome page data in this embodiment. Then, it records the monochrome page data in the page buffer 107.

If the monochrome mode is not set up or the color mode is set, the editing unit transforms the black, yellow, magenta, and cyan printing data into the page data and records the page data in the page buffer 107. Then, it determines whether the preparation of a page of page data is completed. When the preparation is completed, it notifies the expanding section 108 that the preparation of a page of page date is completed.

Now, reference is made to the flow chart.

In Step S11, when the printing data is received, the process goes to Step S12, in which determination is made on whether the monochrome mode is set up. If the monochrome mode is set up, it goes to Step 13. If the monochrome mode is not set up or the color mode is set up, it goes to Step S14.

In Step 13, the yellow, magenta, and cyan printing data is transformed into the monochrome page data and recorded in the page buffer 107.

In Step 14, recording is made in the page buffer 107.

In Step S15, determination is made if the preparation of a page of page data is completed. If the preparation is completed, the process goes to Step S16. If the preparation is not completed, it returns to Step S11.

In Step S16, the expanding section 108 is notified that the preparation of page data is completed and the process is terminated.

Figure 11:
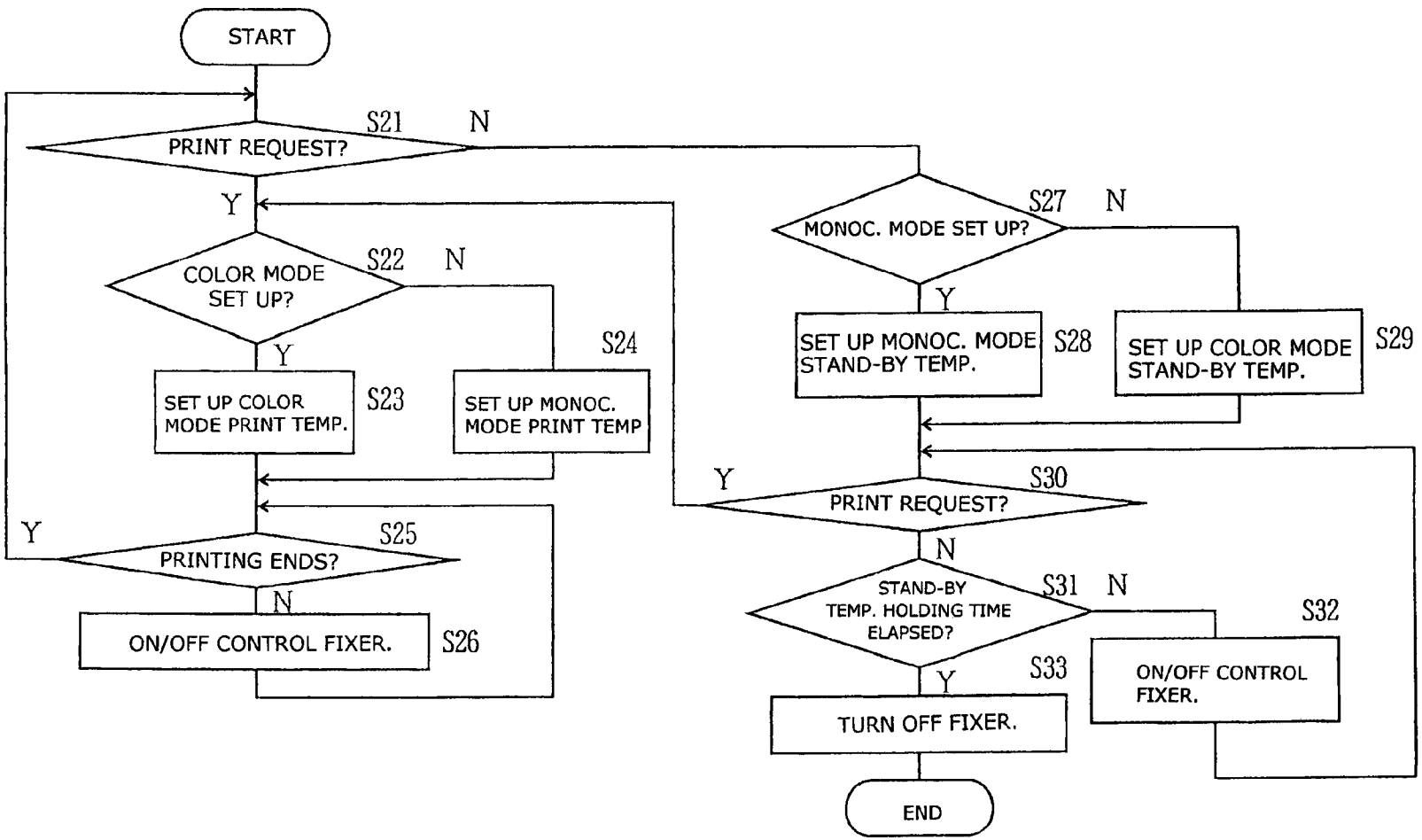
FIG. 11 is a flow chart showing a temperature control process according to the first embodiment.

The temperature control by the fixer control 122 will be described below with reference to FIG. 11. The temperature control section of the fixer control 122 determines if there is a printing request from the controller 101 (FIG. 6). If there is such a request, the temperature control section determines if the color mode is set up. If the color mode is set up, it reads out the color mode printing temperature information from the printing temperature information buffer 129 and sets it as a printing temperature control parameter, thus setting the color mode printing temperature. If the color mode is not set up or the monochrome mode is set up, the temperature control section reads out from the printing temperature information buffer 129 and sets the monochrome mode printing temperature information as a printing temperature control parameter, thus setting the monochrome mode printing temperature.

Then, the temperature control section determines if the printing is completed and continues on/off control of the fixer 63 until the printing is completed. That is, if the detected temperature is lower than the set temperature, the heater 301 is turned on and, if the detected temperature is not lower than the set temperature, the heater is turned off. If there is no printing request, the temperature control section determines if the monochrome mode is set up. If the monochrome mode is set up, the temperature control section reads from the stand-by temperature information buffer 130 and sets the monochrome mode stand-by temperature information as a stand-by temperature control parameter. If the monochrome mode is not set up or the color mode is set up, the temperature control section reads from the stand-by buffer 130 and sets the color mode stand-by temperature information as a stand-by temperature control parameter.

Then, determination is made if there is a printing request for the next page. If there is no such a request, the temperature control section reads out the stand-by temperature holding time from the non-volatile memory 116 and monitors the time after start of the stand-by control to determine if the stand-by temperature holding time elapsed. If the time elapsed, the temperature control section turns off the fixer 63 into the power saving mode and ends the process. If the time does not elapse, the temperature control section performs on/off control of the fixer 63.

Thus, where no image forming unit is set at a place closer to the fixer 63 than the predetermined image forming unit, the temperature of the fixer 63 can be set at a high level. If there is a subsequent printing request in the stand-by state, the worming-up time can be shortened. As a result, the image forming speed is increased and the image forming through-put is improved.

Reference will be made to the flow chart.

In Step S21, determination is made if there is a printing request. If there is one, the process goes to Step S22. If there is no request, the process goes to Step S27.

In Step S22, determination is made if the color mode is set up. If the color mode is set up, the process goes to Step S23. If no color mode is set up or the monochrome mode is set up, the process goes to Step S24.

In Step S23, the color mode printing temperature is set up.

In Step S24, the monochrome mode printing temperature is set up.

In Step S25, determination is made if the printing is completed. If the printing is completed, the process returns to Step S21. If the printing is not completed, the process goes to Step S26.

In Step S26, the on/off control of the fixer 63 is made and the process goes back to Step S25.

In Step S27, determination is made if the monochrome mode is set up. If the monochrome mode is set up, the process goes to Step S28. If the monochrome mode is not set up or the color mode is set up, the process goes to Step S29.

In Step S28, the monochrome mode stand-by temperature is set up.

In Step S29, the color mode stand-by temperature is set up.

In Step S30, determination is made if there is a printing request. If there is one, the process goes back to Step S22. If there is none, the process goes to Step S31.

In Step S31, determination is made if the stand-by temperature holding time elapsed. If the time elapsed, the process goes to Step S33. If the time is not elapse, the process goes to Step S32.

In Step S32, the on/off control of the fixer 63 is made and the process is goes back to Step S30.

In Step S33, the fixer 63 is turned off and the process is terminated.

Figure 12:
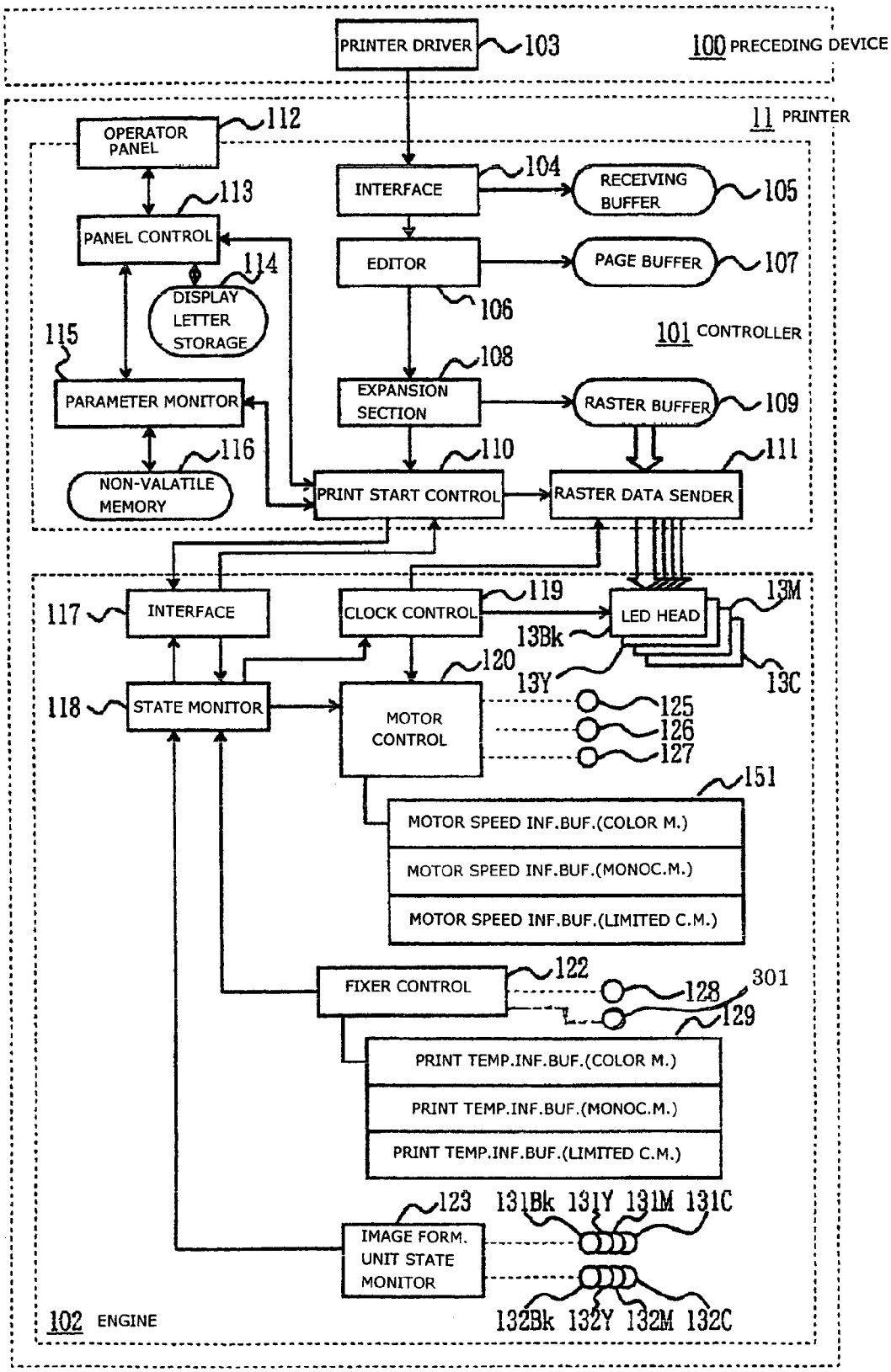
FIG. 12 is a block diagram of a printer control unit according to the second embodiment.

The second embodiment of the invention will now be described with reference to FIG. 12. The same structural elements as those of the first embodiment are given the same reference characters and the description will be omitted. Since the second embodiment has the same structure as that of the first embodiment, it produces the same results as those of the first embodiments. In this embodiment, the black and cyan image forming units R1 and R4 are set in the printer to perform a limited color printing.

The control unit of the printer according to the second embodiment includes a motor speed information buffer 151 for holding the rotation speed information that is different in the color, monochrome, and limited color modes and a printing temperature information buffer 129 for holding the printing temperature information that is different in the color, monochrome, and limited color modes. However, the stand-by temperature information buffer 130 (FIG. 6) in the first embodiment is not provided.

The printing temperature information indicates a printing temperature set for the fixing device or fixer 63 in printing. The motor speed information contains the rotation speeds for the hopping motor 125, the transfer motor 126, and the up/down motor 127 in printing. In the color modes, all the image forming units R1–R4 are set in the printer 11, and the temperature of the image forming unit R4, which is close to the fixer 63, tends to rise high. In the monochrome mode, the image forming units R2–R4 are removed from the printer 11 and the image forming unit R1, which is spaced most from the fixer 63 so that its temperature is hard to rise. Thus, the printing temperature in the monochrome mode is set higher than the printing temperature of the color mode and the stand-by temperature. In the limited color mode, the temperature varies with the set image forming units. Consequently, the printing temperature for the limited color mode is set corresponding to the selected color. The motor speed information is set corresponding to the printing temperature in each mode.

Figure 13:
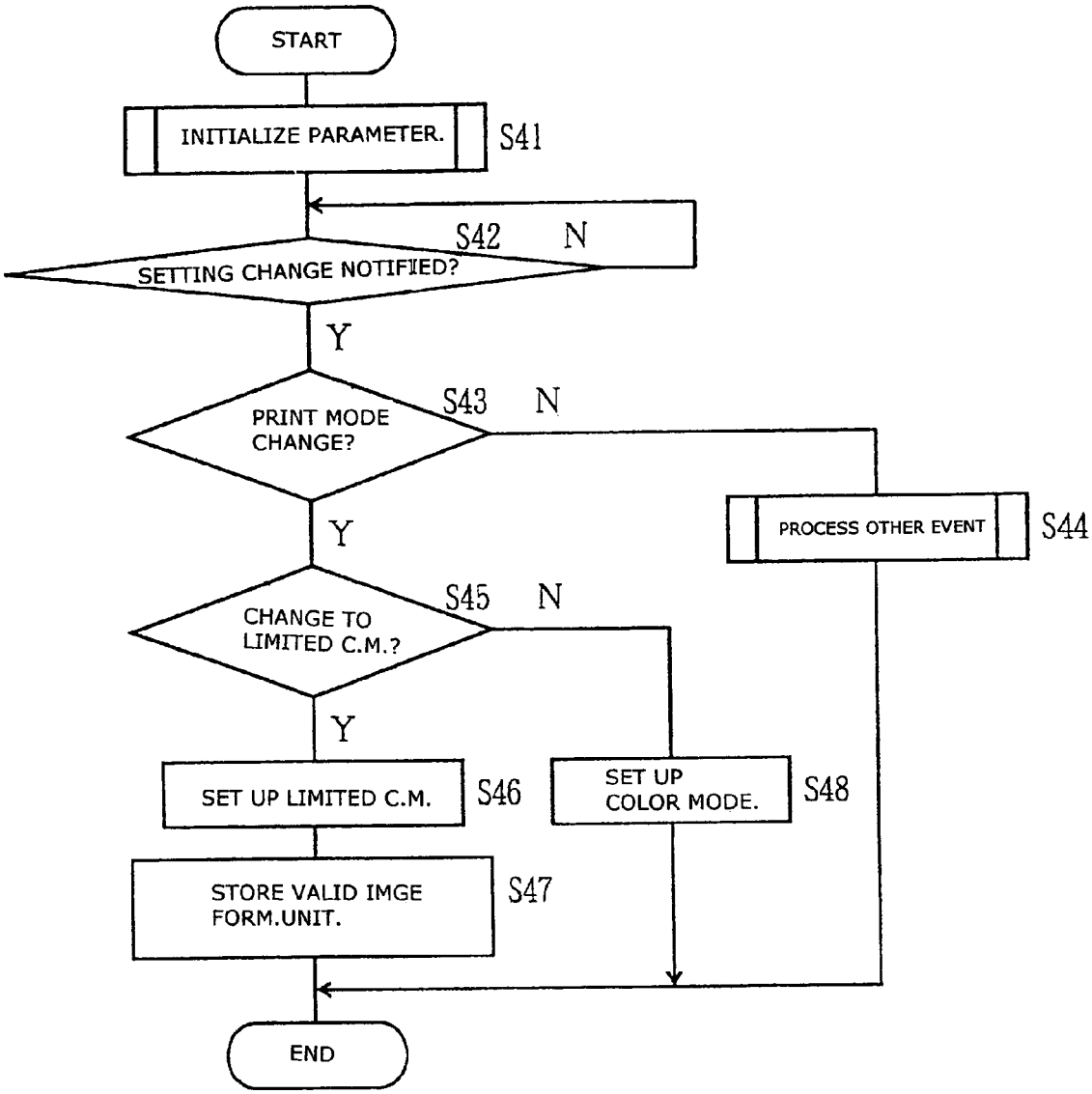
FIG. 13 is a flow chart showing a printing mode setting process according to the second embodiment.

The printing mode setting process will be described with reference to FIG. 13. First of all, when power is turned on, the printing mode setting unit reads out the previous printing mode setting from the non-volatile memory 116 (FIG. 12). The parameter initialization section of the printing mode setting unit performs the parameter initialization process. Then, the print mode setting unit stands by until the change of setting in the printer 11 (FIG. 1) is notified. Upon notification of the change, the printing mode determining section of the printing mode setting unit performs a printing mode determining process to determine if the printing mode is changed. If the changed of the printing mode is determined, the printing mode determining section determines if the change is to the limited color mode. If the printing mode determining section determines that the change is not for the printing mode, the other event processing section of the printing mode setting unit performs the appropriate event process.

If the printing mode determining section determines that the change is for the limited color mode, the mode setting section of the printing mode setting unit performs the mode setting process to set the limited color mode. The mode setting section records in the printing mode information recording area of the non-volatile memory 116 the printing mode information that the limited color mode is set up. The mode setting section then records the black, yellow, magenta, or cyan image forming unit that is made effective by the operator. If the printing mode determining section determines that the change is not for the limited color mode, the mode setting section sets the color mode and records in the printing mode information recording area the printing mode information that the color mode is set up.

Now, reference is made to the flow chart.

In Step S41, the parameter initialization process is performed.

In Step S42, when the change is notified, the process goes to Step S43.

In Step S43, determination is made if the change is for the printing mode. If it is so, the process goes to Step S45 and, otherwise, goes to Step S44.

In Step S44, the other event process is performed and the process is terminated.

In Step S45, determination is made if the change is to the limited color mode. If it is so, the process goes to Step S46 and, otherwise, to Step S48.

In Step S46, the limited color mode is set up.

In Step S47, the image forming unit made effective is recorded and the process is terminated.

In Step S48, the color mode is set up and the process is terminated.

Figure 14:
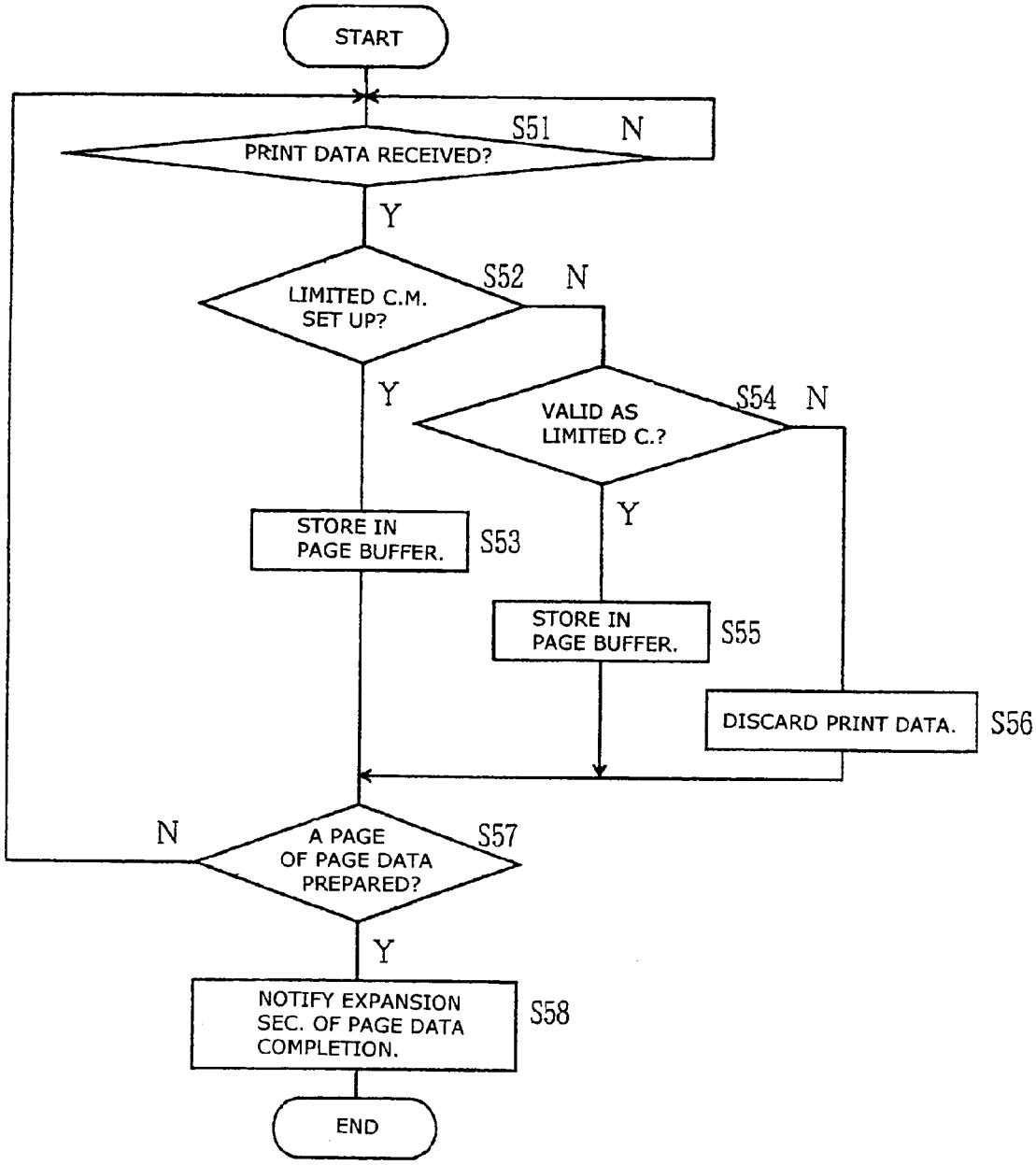
FIG. 14 is a flow chart showing an editing process according to the second embodiment.

The editing process will be described with reference to FIG. 14. First of all, the editing unit checks with the receiving buffer 105 (FIG. 12) and stands by until the printing data is received. Upon reception of the printing data, the editing unit reads the above printing mode information to determine if the limited color mode is set up. If the limited color mode is set up, the editing unit transforms the printing data into the page data. Then, it records the page data in the page buffer 107.

If the editing unit determines that the limited color mode is not set up, it determines if the current printing data is the valid color information for the limited color based on the valid image forming information for the valid image forming unit. If the printing data is the valid color information for the limited color, the editing unit edits the printing data to transform it into and record the page data in the page buffer 107. If the printing data is not valid for the limited color or invalid color information, the editing unit discards the printing data. Then, the editing unit determines if a page of page data is prepared. If the preparation of a page of page data is completed, the editing unit notifies the expanding unit 108 that the preparation of a page of page data is completed.

Now, reference is made to the flow chart.

In Step S51, upon reception of the printing data, the process goes to Step S52.

In Step S52, determination is made if the limited color mode is set up. If so, the process goes to Step S53 and, otherwise, to Step S54.

In Step S53, recording is made in the page buffer 107.

In Step S54, determination is made if the color information is valid for the limited color. If so, the process goes to Step S55 and, otherwise or the color information is invalid, goes to Step S56.

In Step S55, recording is made in the page buffer 107.

In Step S56, the printing data is discarded.

In Step S57, determination is made if a page of page data is prepared. If the preparation is completed, the process goes to Step S58 and, otherwise, goes back to Step S51.

In Step S58, the expanding unit 108 is notified that the preparation of page data is completed and the process is terminated.

Figure 15:
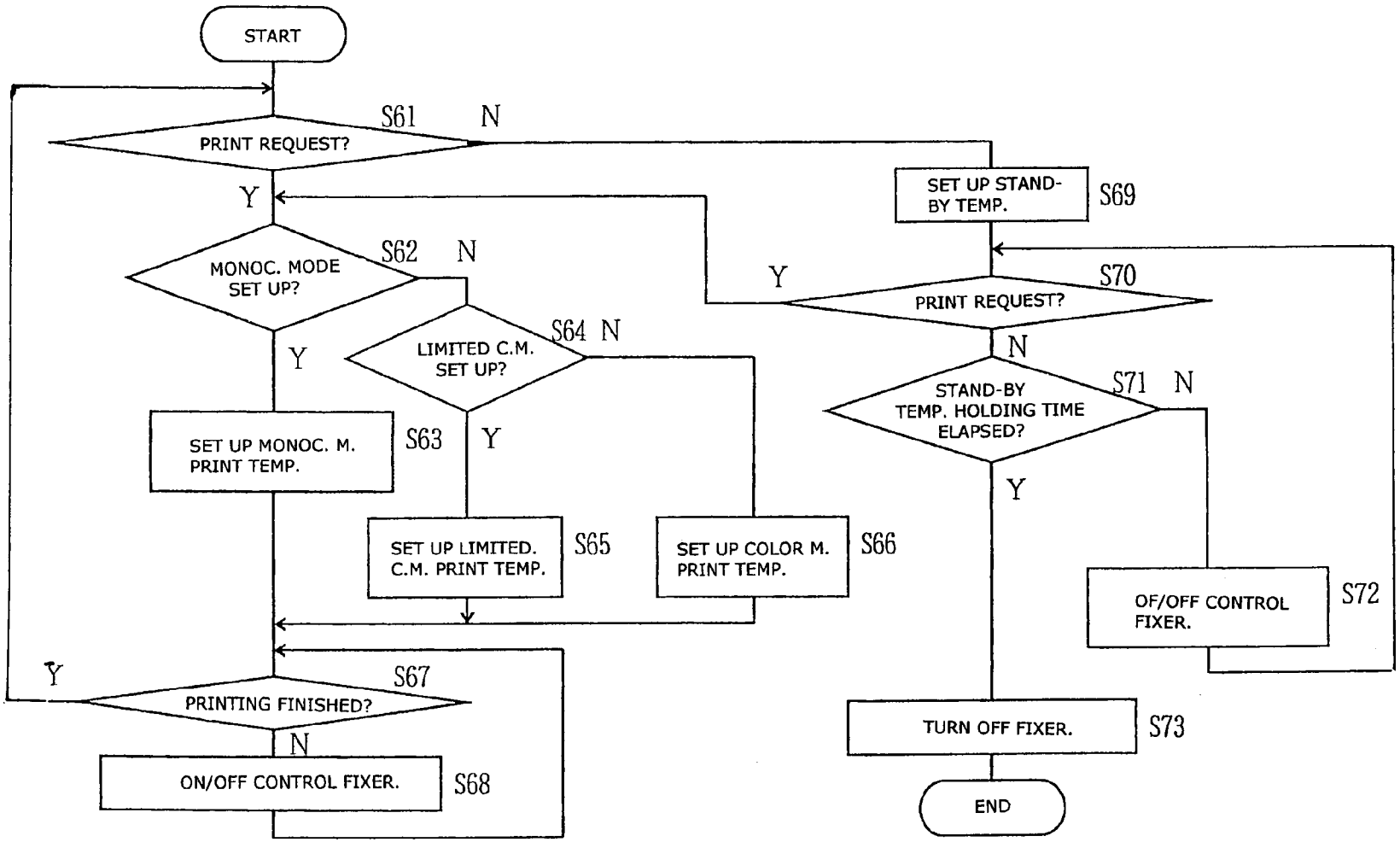
FIG. 15 is a flow chart showing a temperature control process according to the second embodiment.

The temperature control process will be described with reference to FIG. 15. First of all, the temperature control unit determines if there is a printing request from the controller 101 (FIG. 12). If there is a printing request, the temperature control unit determines if the monochrome mode is set up. If the monochrome mode is set up, the temperature control unit reads out the printing temperature information for the monochrome mode from the printing temperature information buffer 129. Then, it sets the monochrome mode printing temperature information as a printing temperature control parameter.

If the monochrome mode is not set up, the temperature control unit determines if the limited color mode is set up. If the limited color mode is set up, the temperature control unit reads out the printing temperature information for the limited color mode from the printing temperature information buffer 129. Then, it sets the limited color mode printing temperature information as a printing temperature control parameter. If the limited color mode is not set up, the temperature control unit reads out the color mode printing temperature information from the printing temperature information buffer 129. Then, it sets the color mode printing temperature information as a printing temperature control parameter. Then, it determines if the printing is completed. It continues on/off control of the fixer 63 (FIG. 7) until the printing is completed.

If there is no printing request, the temperature control unit sets a predetermined stand-by temperature as a set temperature. Then, it determines if there is a next page printing request. If there is no next page printing request, it reads out the stand-by temperature holding time from the non-volatile memory 116 and monitors the time from start of the stand-by control to determine if the stand-by temperature holding time elapsed. If the time elapsed, it turns off the fixer 63 into the power saving mode and the process is terminated. If the stand-by temperature holding time does not elapse, it performs on/off control of the fixer 63.

Now, reference is made to the flow chart.

In Step S61, determination is made if there is a printing request. If there is one, the process goes to Step S62 and, otherwise, to Step S69.

In Step S62, determination is made if the monochrome mode is set up. If the monochrome mode is set up, the process goes to Step S63 and, otherwise, to Step S64.

In step S63, the printing temperature is set up for the monochrome mode.

In Step S64, determination is made if the limited color mode is set up. If the limited color mode is set up, it goes to Step S65 and, otherwise, to Step S66.

In Step S65, the printing temperature is set for the limited color mode.

In Step S66, the printing temperature is set for the color mode.

In Step S67, determination is made if the printing is completed. If the printing is completed, it goes back to Step S61 and, otherwise, goes to Step S68.

In Step S68, on/off control of the fixer 63 is made and the process goes back to Step S67.

In Step S69, the stand-by temperature is set up.

In Step S70, determination is made if there is a printing request. If there is one, the process goes back to Step S62 and, otherwise, goes to Step S71.

In Step S71, determination is made if the stand-by temperature holding time elapsed. If the time elapsed, the process goes to Step S73 and, otherwise, to Step S72.

In Step S72, on/off control of the fixer 63 is performed and the process goes back to Step S70.

In Step S73, on/off control of the fixer 63 is performed and the process is terminated.

Figure 16:
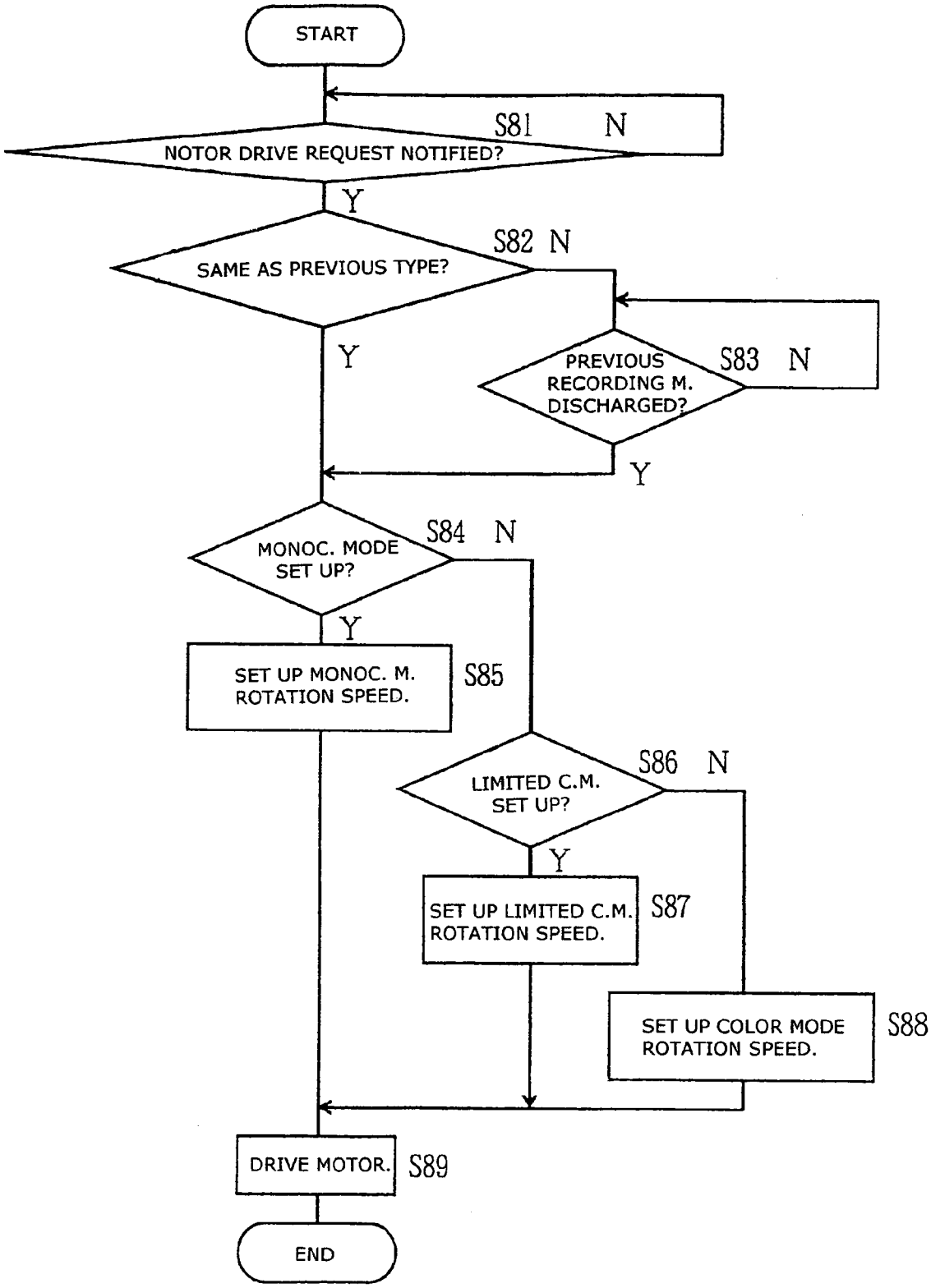
FIG. 16 is a flow chart showing a motor control process according to the second embodiment.

The motor control process will be described with reference to FIG. 16. First of all, the motor control section of the motor control unit 120 stands by for notification of a motor driving request from the state monitoring unit 118 (FIG. 12). Upon reception of the notification, the motor control section determines the type of the motor driving request, such as the color, monochrome, or limited color mode, to decide if it is the same type as the previous one. If it is different from the previous motor driving request, the motor control section stands by until the previous recording medium S (FIG. 7) is discharged. If it is the same type as the previous one, the motor control section immediately determines if the monochrome mode is set up.

When the previous recording medium S is discharged in the motor driving request type different from the previous one, the motor control section determines if the monochrome mode is set up. If it is set up, the motor control section acquires the motor control information for the monochrome mode from the motor control information. It then sets the monochrome mode motor control information as a motor control parameter to set the rotation speed for the monochrome mode.

If the monochrome mode is not set up, the motor control section determines if the limited color mode is set up. If it is set up, the motor control section acquires the limited color mode motor control information from the motor control information to set it as a motor control parameter and the limited color mode rotation speed. Then, based on the rotation speed, the motor control section drives the motors, such as the hopping motor 125 and the transfer motor 126, to change the transfer speed of the recording medium S.

Thus, if the limited color mode is set up, the printing temperature is set at the temperature corresponding to the color selected in the limited color mode, and the transfer speed of the recording medium S is set corresponding to the printing temperature. As a result, the image forming speed is increased to improve the image forming through-put.

Now, reference is made to the flow chart.

In Step S81, upon reception of a motor driving request, the process goes to S82.

In Step S82, determination is made if it is the same type as that of the previous motor driving request. If it is the same type, the process goes to Step S84 and, otherwise, to Step S83.

In Step S83, when the previous recording medium S is discharged, the process goes to Step S84.

In Step S84, determination is made if the monochrome mode is set up. If it is set up, the process goes to Step S85 and, otherwise, to Step S86.

In Step S85, the monochrome mode rotation speed is set up.

In Step S86, determination is made if the limited color mode is set up. If it is set up, the process goes to Step S87 and, otherwise, to Step S88.

In Step S87, the limited color mode rotation speed is set up.

In Step S88, the color mode rotation speed is set up.

In Step S89, the motor is driven and the process is terminated.

Figure 17:
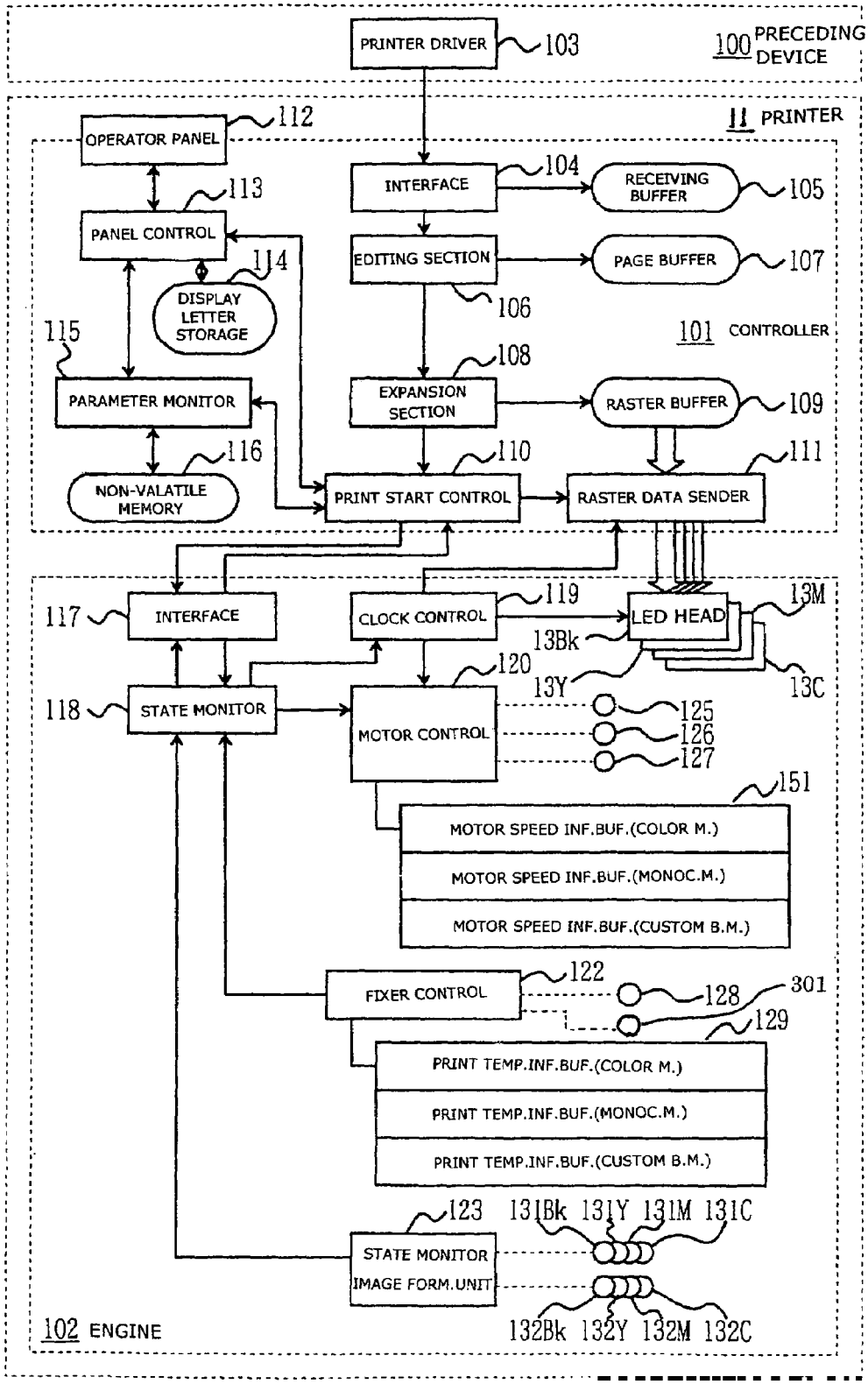
FIG. 17 is a block diagram of a printer control unit according to the third embodiment.

The third embodiment will now be described with reference to FIG. 17, in which the same structural elements are given the same reference characters as those of the first and second embodiments and their description will be omitted. In this embodiment, the yellow, magenta, and cyan image forming units R2–R4 are used to perform the color mode printing and custom made black printing.

The motor control unit 120 is provided with a motor speed information buffer 151 for holding the rotation speed information that is different in the color, monochrome, and custom black modes and a printing temperature information buffer 129 for holding the printing temperature information that is different in the color, monochrome, and custom black modes. The stand-by temperature information buffer 130 (FIG. 6) is not provided. The printing temperature information contains a printing temperature set for the fixer 63 (FIG. 1) in printing. The motor speed information contains rotation speeds for the hopping motor 125 in printing, the transfer motor 126, and the up/down motor 127.

Figure 18:
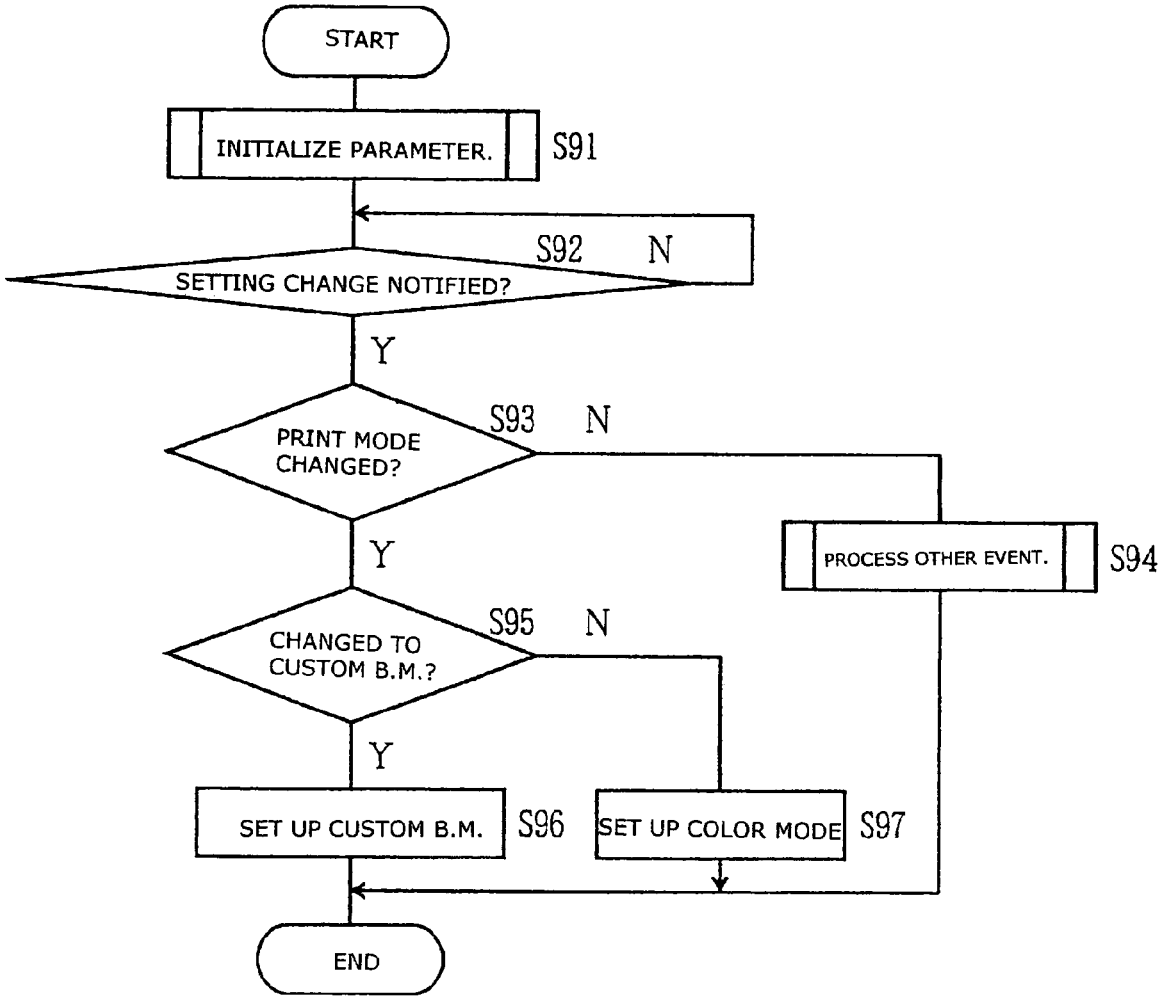
FIG. 18 is a flow chart showing a printing mode setting process according to the third embodiment.

The printing mode setting process will be described with reference to FIG. 18. When power is turned on, the printing mode setting section reads out the previous printing mode setting from the non-volatile memory 116 (FIG. 17). Based on the printing mode setting, the parameter initialization section of the printing mode setting unit performs the parameter initialization process. Then, the printing mode setting section stands by for notification of a change in the setting of the printer 11 (FIG. 1).

When the setting change is notified, the printing mode determining section of the printing mode setting unit performs the printing mode determining process. If the printing mode is changed, the printing mode determining section determines if the change is for the custom black mode. If the printing mode is not changed, the other event processing section of the printing mode setting unit performs the other event process.

If it is changed to the custom black mode, the mode setting section of the printing mode setting unit performs the mode setting process to set the custom black mode. Then, the mode setting section records in the printing mode information recording area of the non-volatile memory 116 the printing mode information that the custom black mode is set up. If the change is not for the custom black mode, the mode setting section sets up the color mode and records in the printing mode information recording area the printing mode information that the color mode is set up.

Now, reference is made to the flow chart.

In Step S91, the parameter initialization is made.

In Step S92, when a change is notified, the process goes to Step S93.

In Step S93, determination is made if the printing mode is changed. If it is changed, the process goes to Step S95 and, otherwise, to Step S94.

In Step S94, the other event is processed and the process is terminated.

In Step S95, determination is made if the change is for the custom black mode. If so, the process goes to Step S96 and, otherwise, to Step S97.

In step S96, the custom black mode is set up and the process is terminated.

In Step S97, the color mode is set up and the process is terminated.

Figure 19:
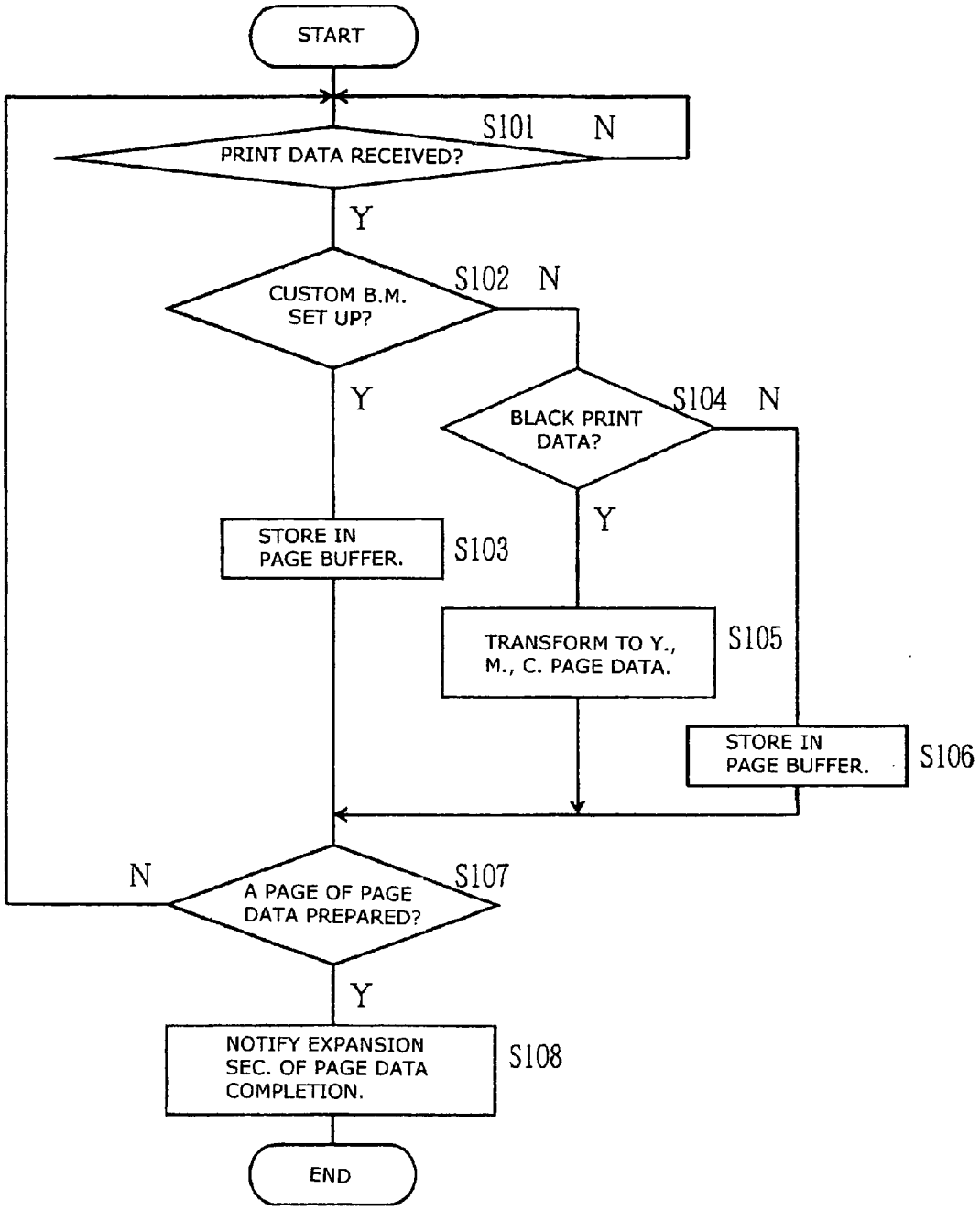
FIG. 19 is a flow chart showing an editing process according to the third embodiment.

The editing process will be described with reference to FIG. 19. The editing section of the editing unit 106 checks with the receiving buffer 105 (FIG. 7) and stands by for reception of a printing data. Upon reception of a printing data, the editing section reads the printing mode information to determine if the custom black mode is set up. If it is set up, the editing section edits the printing data as an ordinary data and transforms it into a page data and records it in the page buffer 107. If the custom black mode is not set up, the editing section determines if the current printing data is the black printing data based on the valid image forming information.

If the printing data is the black printing data, the editing section edits the black printing data to transform the black printing data into the yellow, magenta, and cyan page data and record them in the page buffer 107. If the printing data is not the black printing data, it edits the printing data and transforms it into the page data without change and records it in the page buffer 107. Then, the editing section determines if a page of page data is prepared. If a page of page data is prepared, it notifies the expanding unit 108 that the preparation of a page of page data is completed.

Now, reference is made to the flow chart.

In step S101, the process stands by for reception of a printing data. Upon reception of the printing data, the process goes to Step S102.

In Step S102, determination is made if the custom black mode is set up. If it is set up, the process goes to Step S103 and, otherwise, to Step S104.

In Step S103, recording is made into the page buffer 107.

In Step S104, determination is made if it is the black printing data. If it is the black printing data, the process goes to Step S105 and, otherwise, to Step S106.

In Step S105, transformation is made to the yellow, magenta, and cyan page data.

In Step S106, recording is made in the page buffer 107.

In step S107, determination is made if a page of page data is prepared. If it is completed, the process goes to Step S108 and, otherwise, goes back to Step S101.

In Step S108, the expanding unit 108 is notified that the preparation of a page data is completed and the process is terminated.

Figure 20:
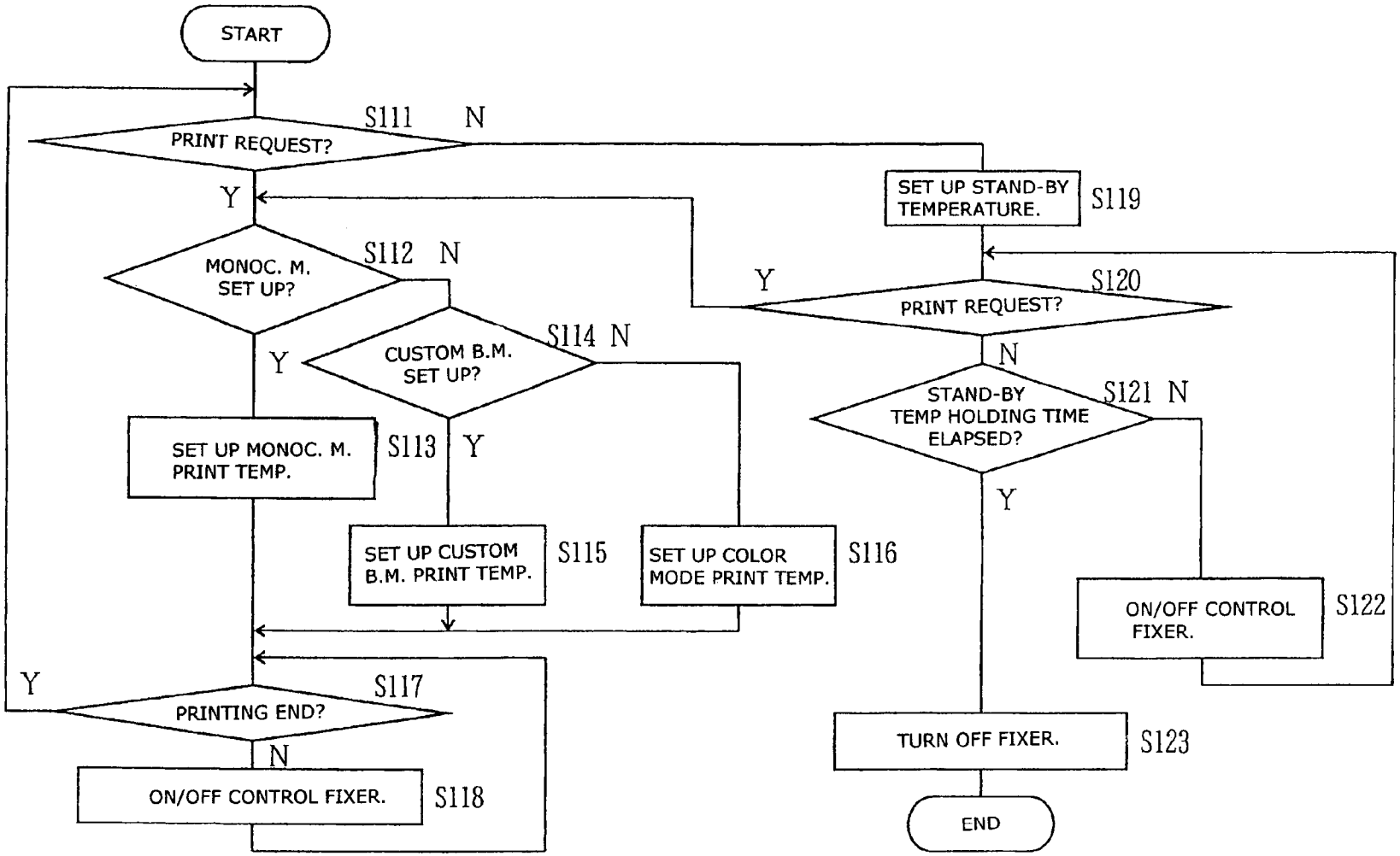
FIG. 20 is a flow chart showing a temperature control process according to the third embodiment.

The temperature control process will be described with reference to FIG. 20. The temperature control section of the fixer control unit 122 determines if there is a printing request from the controller 101 (FIG. 17). If there is a printing request, it determines if the monochrome mode is set up. If the monochrome mode is set up, it reads out the monochrome mode printing temperature information from the printing temperature information buffer 129. Then, it sets the monochrome mode printing temperature information as a printing temperature control parameter and the monochrome mode printing temperature as a set temperature.

If the monochrome mode is not set up, it determines if the custom black mode is set up. If the custom black mode is set up, it reads out the color mode printing temperature information from the printing temperature information buffer 129. Then, it sets the color mode printing temperature information as a printing temperature control parameter and the color mode printing temperature as a set temperature. Then, it determines if the printing is completed and continues on/off control of the fixer 63 (FIG. 1) until the printing is completed.

If there is no printing request from the controller 101 (FIG. 17), it sets a predetermined stand-by temperature as a set temperature. Then, it determines if there is a printing request for the next page. If there is no request for the next page, it reads out the stand-by temperature holding time from the non-volatile memory 116. Then, it determines if the stand-by temperature holding time elapsed by monitoring the time since the stand-by control starts. If the time elapsed, it turns off the fixer 63 into the power saving mode and ends the process. If the stand-by temperature holding time does not elapse, it performs on/off control of the fixer 63.

Now, reference should be made to the flow chart.

In Step S111, determination is made if there is a printing request. If there is one, the process goes to Step S112 and, otherwise, to Step S119.

In Step S112, determination is made if the monochrome mode is set up. If there is one, the process goes to Step S113 and, otherwise, to Step S114.

In Step S113, the monochrome mode printing temperature is set up.

In Step S114, determination is made if the custom black mode is set up. If there is one, the process goes to Step S115 and, otherwise, to Step S116.

In Step S115, the custom black mode printing temperature is set up.

In Step S116, the color mode printing temperature is set up.

In Step S117, determination is made if the printing is completed. If it is completed, the process goes back to Step S111 and, otherwise, goes to step S118.

In Step S118, the fixer 63 is turned on/off and the process goes back to Step S117.

In step S119, the stand-by temperature is set up.

In Step S120, determination is made if there is a printing request. If there is one, the process goes back to Step S112 and, otherwise, goes to Step S121.

In Step S121, determination is made if the stand-by temperature holding time elapsed. If it elapsed, the process goes to Step S123 and, otherwise, to Step S122.

In Step S122, the fixer 63 is turned on/off and the process goes back to Step S120.

In Step S123, the fixer 63 is turned off and the process is terminated.

Figure 21:
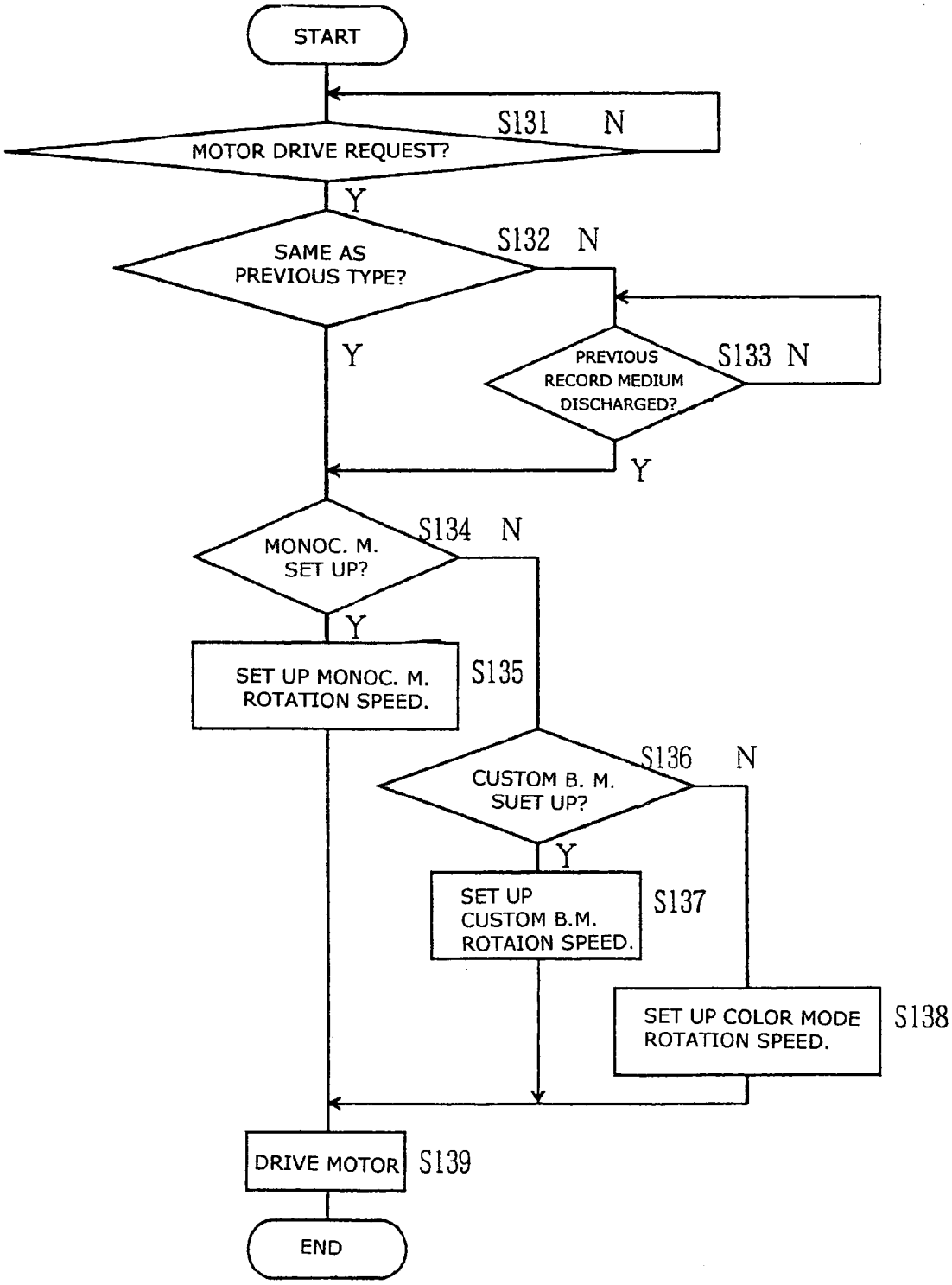
FIG. 21 is a flow chart showing a motor control process according to the third embodiment.

The motor control process will be described with reference to FIG. 21. The motor control section of the motor control unit 120 stands by until a motor drive request is notified by the state monitor 118 (FIG. 17). Upon notification of the motor drive request from the state monitor 118, it determines the type (color, monochrome, or custom black mode) of the motor drive request. Then, it determines if the type determined is the same as that of the previous motor drive request. If it is different from the type of the previous motor drive request, it stands by until the previous recording medium S (FIG. 1) is discharged.

If it is the same type as the previous one, immediately it determines if the monochrome mode is set up. If the type is different from the previous one, it determines if the monochrome mode is set up when the previous recording medium S is discharged. If there is one set up, it takes out the monochrome mode motor control information from the motor control information. Then, it sets the monochrome mode motor control information as a motor control parameter to set the monochrome mode rotation speed.

If the monochrome mode is not set up, it determines if the custom black mode is set up. If there is one set up, it takes out the custom black mode motor control information from the motor control information. Then, it sets the custom black mode motor control information as motor control parameter to set the custom black mode rotation speed. If the custom black mode is not set up, it takes out the color mode motor control information from the motor control information. Then, it sets the color mode motor control information as motor control parameter to set the color mode rotation speed. Then, based on the above rotation speed, it drives motors, such as the hopping motor 125 and the transfer motor 126, to change the transfer speed of the recording medium S.

Thus, when the custom black mode is set up, the printing temperature is set up corresponding to the color selected in the custom black mode and the transfer speed of the recording medium S is set up corresponding to the printing temperature. As a result, the image forming speed is increased and the image forming through-put is increased.

Now, reference should be made to the flow chart.

In Step S131, if a motor drive request is notified, the process goes to Step S132.

In Step S132, determination is made if the type of the motor drive request is the same as that of the previous request. If it is the same one, the process goes to Step S134 and, otherwise, to Step S133.

In Step S133, when the previous recording medium is discharged, the process goes to Step S134.

In Step S134, determination is made if the monochrome mode is set up. If there is one set up, the process goes to Step S135 and, otherwise, to Step S136.

In Step S135, the monochrome mode rotation speed is set up.

In Step S136, determination is made if the custom black mode is set up. If there is one set up, the process goes to Step S137 and, otherwise, to Step S138.

In Step S137, the custom black mode rotation speed is set up.

In Step S138, the color mode rotation speed is set up.

In Step S139, the motor is driven and the process is terminated.

Figure 22:
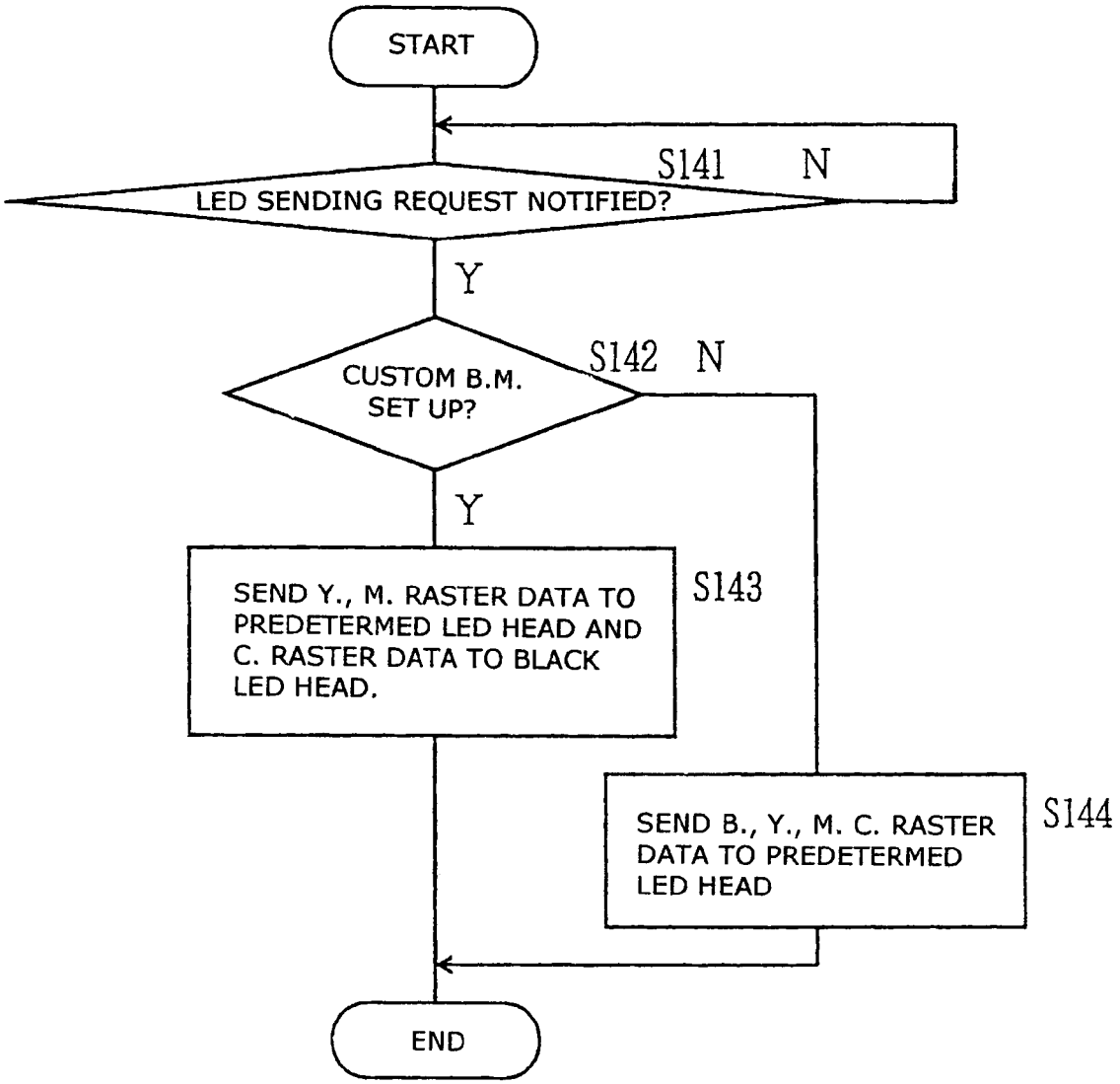
FIG. 22 is a flow chart showing a raster data sending process according to the third embodiment.

The raster data sending process will be described with reference to FIG. 22. The raster data sending section of the raster data sending unit 111 stands by for an LED sending request from the printing control starting unit 110 (FIG. 17). If the LED sending request is notified, it determines if the custom black mode is set up. If the custom black mode is set up, it sends the yellow, magenta, and cyan raster data from the raster buffer 109 to the LED head 13Y, 13M, and 13Bk, respectively.

If the custom black mode is not set up, it sends the black raster data from the raster buffer 109 to the LED head 13Bk and the yellow, magenta, and cyan raster data to the LED heads 13Y, 13M, and 13C, respectively.

Now, reference should be made to the flow chart.

In Step S141, if an LED sending request is notified, the process goes to Step S142.

In Step S142, determination is made if the custom black mode is set up. If it is set up, the process goes to Step S143 and, otherwise, to Step S144.

In Step S143, the yellow, magenta, and cyan raster data are sent to the LED heads 13Y, 13M, and 13Bk, respectively, and the process is terminated.

Figure 23:
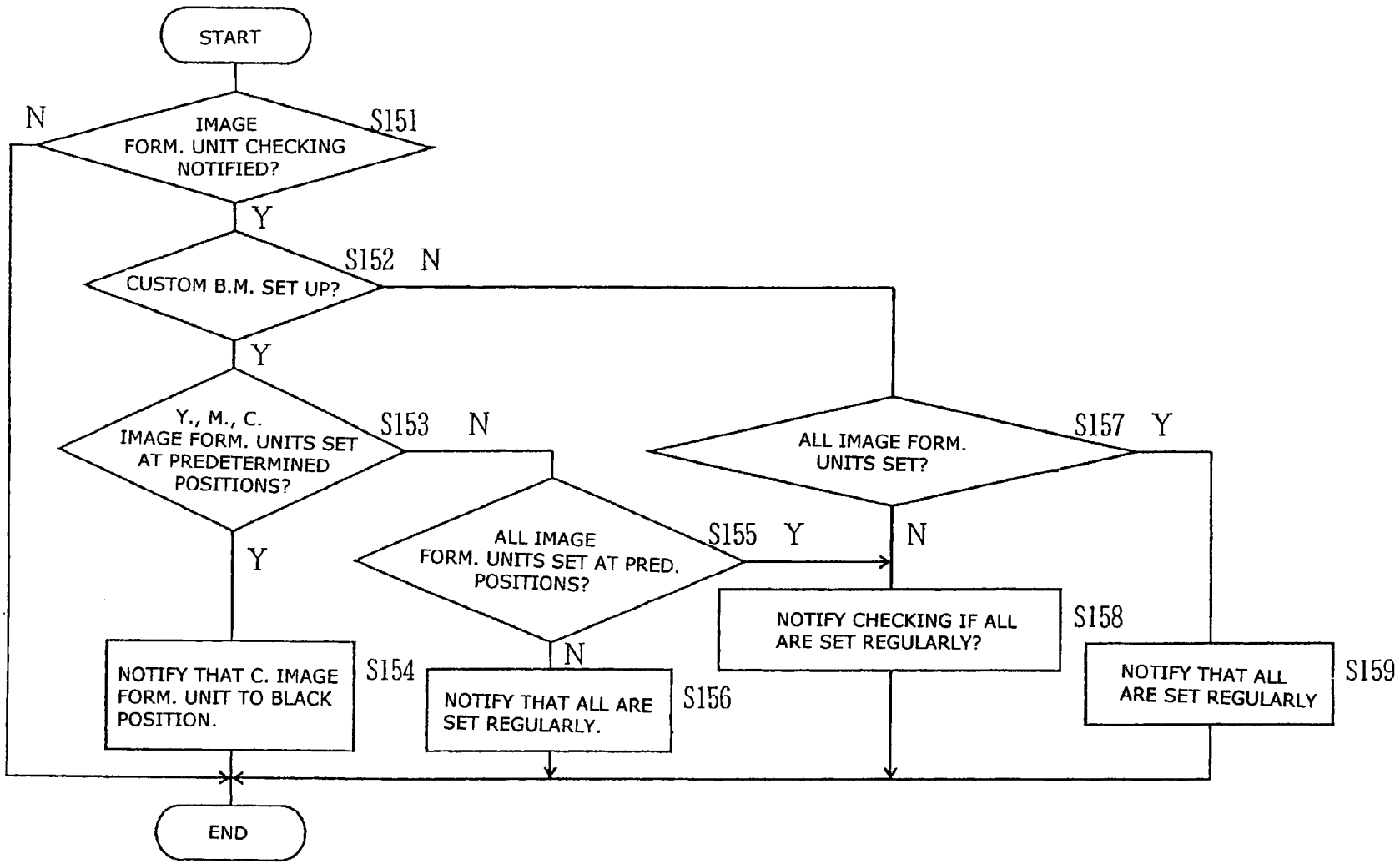
FIG. 23 is a flow chart showing an image forming unit monitoring process according to the third embodiment.

The image forming state monitoring process will be described with reference to FIG. 23. The image forming state monitoring section of the image forming state monitor 123 determines if an image forming section checking request is notified. If such a request is notified, it determines if the custom black mode is set up. If there is one set up, it determines if the respective yellow, magenta, and cyan image forming units R2–R4 (FIG. 1) are set at predetermined positions. If they are set at the predetermined positions, it notifies the operator that the cyan image forming unit R4 is moved to the black position.

If the yellow, magenta, and cyan image forming units R2–R4 are not set at the predetermined positions, it determines if all the image forming units R1–R4 are set at the predetermined positions. If they are set at the predetermined positions, it notifies the state monitor 118 that all the image forming units R1–R4 are set at the regular positions.

If the custom black mode is not set up, it determines if all the image forming units R1–R4 are set. If all the units R1–R4 are set, it notifies the state monitor 118 that all the units R1–R4 are set regularly. If one of the units R1–R4 is not set, it instructs the operator to check if the image forming units are set regularly. Thus, the state that the image forming units are set is monitored.

If the custom black mode is set up, the image forming unit R4, which is closest to the fixer 63, is moved to the black position that is furthest away from the fixer 63. Thus, the heat of the fixer 63 is prevented from influence the image forming unit R4. As a result, not only the temperature of the custom black mode can be set high but also the rotation speed of the motor can be made high. Thus, the image forming speed and through-put can be increased.

Reference is made to the flow chart.

In Step S151, determination is made if an image forming section checking request is notified. If such notification is made, the process goes to Step S152 and, otherwise, the process is terminated.

In Step S152, determination is made if the custom black mode is set up. If such a mode is set up, the process goes to Step S153 and, otherwise, to Step S157.

In Step S153, determination is made if the yellow, magenta, and cyan image forming units R2–R4 are set at the respective predetermined positions. If such image forming units R2–R4 are set at the predetermined positions, the process goes to Step S154 and, otherwise, to Step S155.

In Step S154, it is notified that the cyan image forming unit R4 is moved to the black position and the process is terminated.

In Step S155, determination is made if all the image forming units R1–R4 are set at the predetermined positions. If all of them are set at the predetermined positions, the process goes to Step S158 and, otherwise, to Step S156.

In Step S156, it is notified that all the units are set regularly and the process is terminated.

In Step S157, determination is made if all the image forming units R1–R4 are set. If all the units are set, the process goes to Step S159 and, otherwise, to Step S158.

In Step S158, it is notified to check that all the units are set regularly and the process is terminated.

In Step S159, it is notified that all the units are set regularly and the process is terminated.

In this embodiment, determination is made if each of the image forming units R1–R4 is set, but only one or more image forming units can be selected and set. In this case, a selection section is provided to select image forming units. When the operator manipulates the section to select an image forming unit, the set temperature of the fixer 63 is changed.

Figure 24:
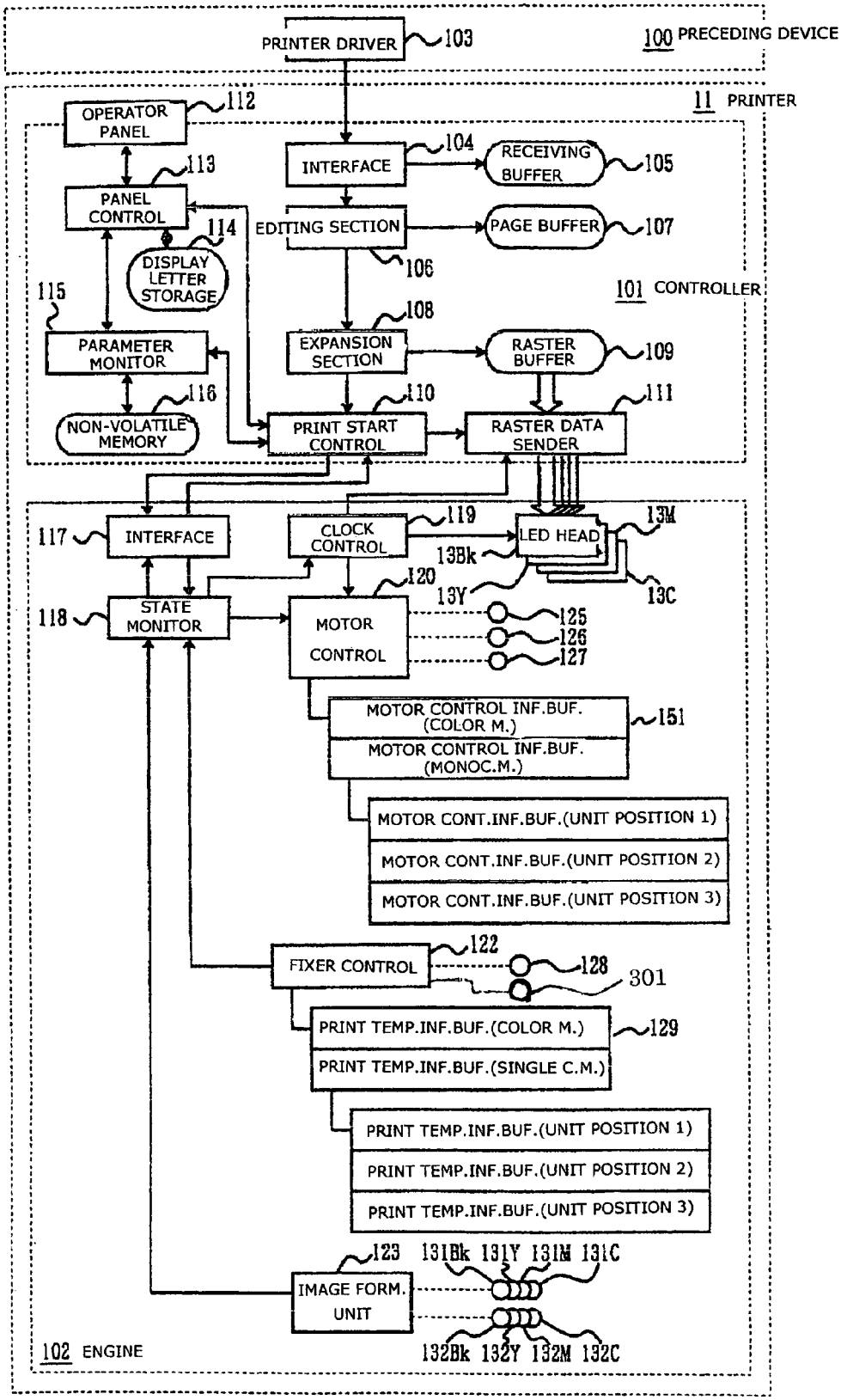
FIG. 24 is a block diagram of a printer control unit according to the fourth embodiment.

The fourth embodiment will now be described with reference to FIG. 24. The same structural elements as those of the first, second, or third embodiment will be given the same reference characters as those of the first, second, or third embodiment and their description will be omitted. The same structural portion as that of the first, second, or third embodiment produces the same results as that of the first, second, or third embodiment. In this embodiment, the respective color image forming units are set at the positions to make single color printing.

The motor control unit 120 is provided with a motor speed information buffer 151 that holds a color mode rotation speed information and a single color mode rotation speed information. The color and single color mode rotation speed information is different from each other. The motor control unit 120 is also provided with a printing temperature information buffer 129 that holds a color mode printing temperature information and a single color mode printing temperature information. The color and single color mode temperature information is different from each other.

In the single color mode, the motor speed information buffer 151 holds the position information about the valid image forming unit or the motor speed information for each image forming unit position 1, 2, or 3. The printing temperature information buffer 129 holds the printing temperature information at each valid image forming unit position 1, 2, or 3. The stand-by temperature information buffer 130 (FIG. 6) of the first embodiment is not provided.

Figure 25:
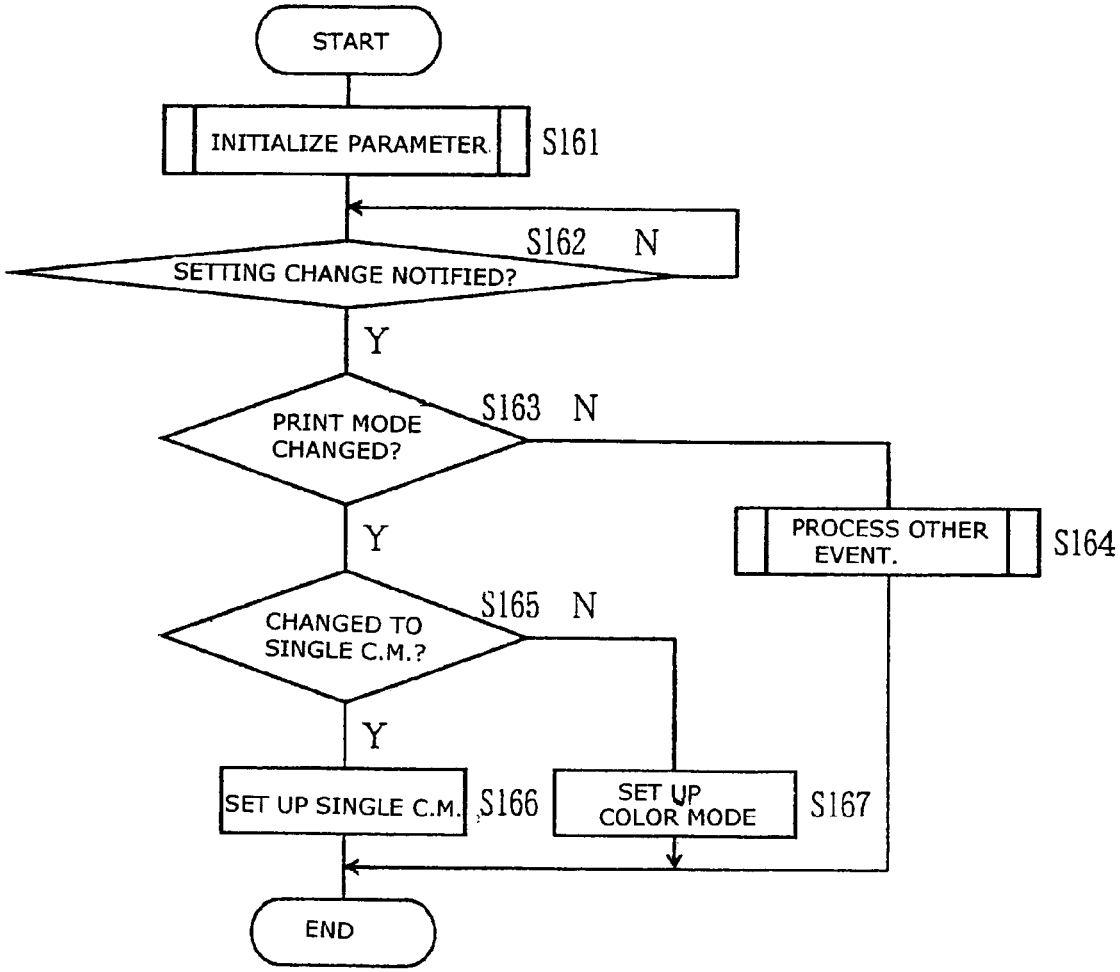
FIG. 25 is a flow chart showing a printing mode setting process according to the fourth embodiment.

The printing mode setting process will be described with reference to FIG. 25. When power is turned on, the printing mode setting section of the controller 101 reads out the previous printing mode setting from the non-volatile memory 116 (FIG. 24). Then, the parameter initialization section of the printing mode setting section performs a parameter initialization process with the previously set printing mode setting. Then, the printing mode setting section stands by for notification of a change of the setting for the printer 11 (FIG. 1). When such notification is made, the printing mode determining section of the printing mode setting section performs a printing mode determining process to determine if it is a change of the printing mode.

If it is a printing mode change, the printing mode determining section determines if it is a change to the single color mode. If it is not a change of the printing mode, the other event processing section of the printing mode setting section performs the other event process. If it is a change to the single color mode, the mode setting process performs a mode setting process and sets up the single color mode and records in the printing mode information recording area of the non-volatile memory 116 that the single color mode is set up. If it is not a change to the single color mode, the mode setting section sets up the color mode and stores in the printing mode information recording area that the color mode is set up.

Reference is made to the flow chart.

In Step S161, the parameter initialization process is made.

In Step S162, when the change is notified, the process goes to Step S163.

In Step S163, determination is made if the printing mode is changed. If such a change is determined, the process goes to Step S165 and, otherwise, to Step S164.

In Step S164, the other event process is made and the process is terminated.

In Step S165, determination is made if it is a change to the single color mode. If it is a change to the single mode, the process goes to Step S166 and, otherwise, to Step S167.

In Step S166, the single mode is set up and the process is terminated.

In Step S167, the color mode is set up and the process is terminated.

Figure 26:
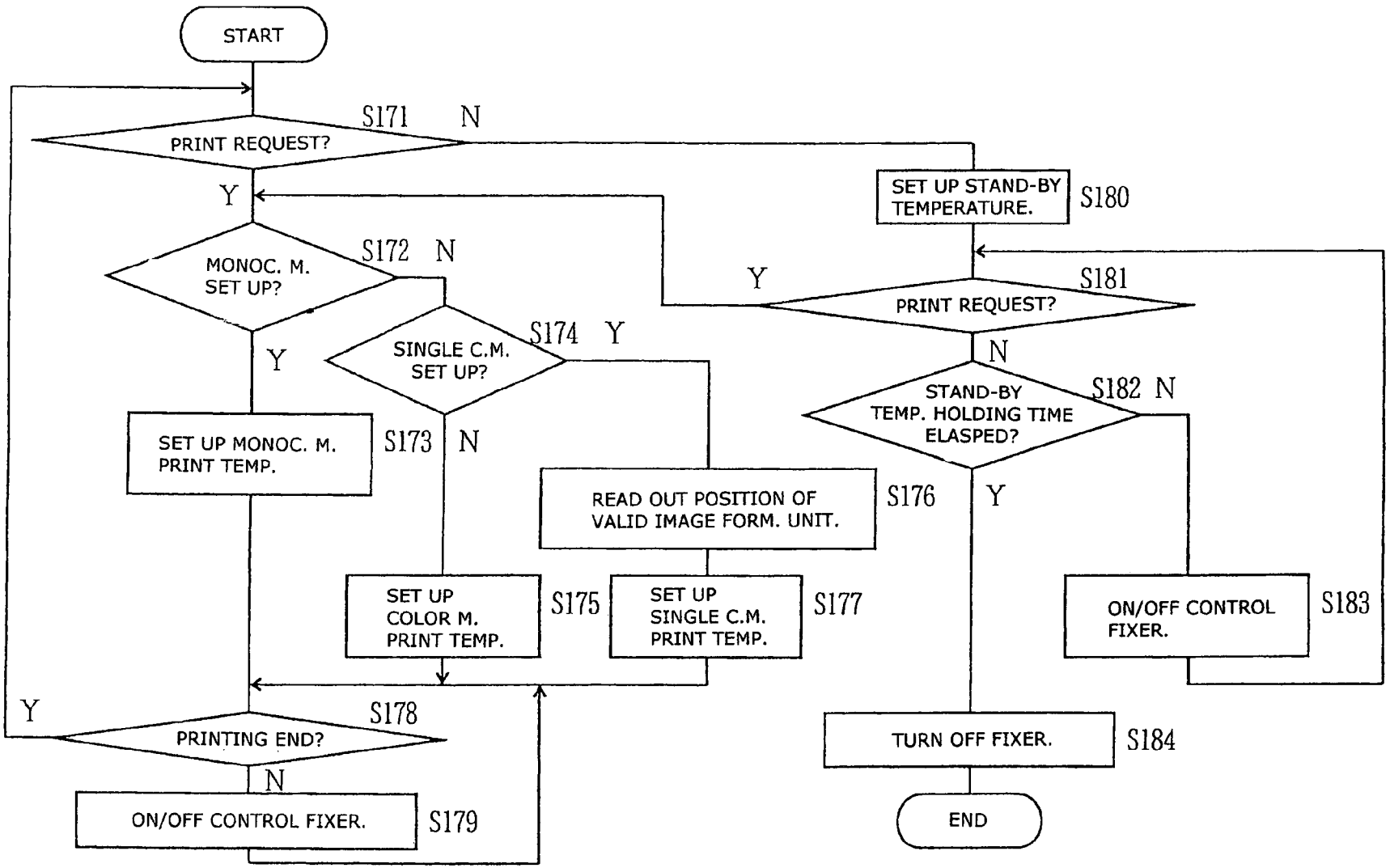
FIG. 26 is a flow chart showing a temperature control process according to the fourth embodiment.

The temperature control process will be described with reference to FIG. 26. The temperature control section determines if there is a printing request from the controller 101 (FIG. 24). If there is one, it determines if the monochrome mode is set up. If the monochrome mode is set up, it reads out the monochrome mode printing temperature information from the printing temperature information buffer 129 and sets it as a printing temperature control parameter to set up the monochrome mode printing temperature as a set temperature. If the monochrome mode is not set up, the temperature control section determines if the single color mode is set up. If such a mode is set up, it reads out not only the position where the image forming unit is made valid but also the single color mode printing temperature information (at the predetermined position of the valid image forming unit among the image forming unit positions 1–3) and sets it as a printing temperature control parameter to set the single color mode printing temperature as a set temperature.

If the single color mode is not set up, the temperature control section reads out the color mode printing information from the printing temperature information buffer 129 and sets it as a printing temperature control parameter to set the color mode printing temperature as a set temperature. Then, it determines if the printing is completed and continues on/off control of the fixer 63 (FIG. 1) until the printing is completed.

If there is no printing request, the temperature control section sets the predetermined stand-by temperature as a set temperature. Then, it determines if there is a next page printing request. If there is no such request, it reads out the stand-by temperature holding time from the non-volatile memory 116 and monitors the time since the stand-by control started. If the stand-by control time elapsed, it turns off and brings the fixer 63 into the power saving mode and the process is terminated. If the stand-by temperature holding time does not elapse, it performs on/off control of the fixer 63.

Reference is made to the flow chart.

In Step S171, determination is made if there is a printing request. If there is one, the process goes to Step S172 and, otherwise, to Step S180.

In Step S172, determination is made if the monochrome mode is set up. If it is set up, the process goes to Step S173 and, otherwise, to Step S174.

In Step S173, the monochrome mode printing temperature is set up.

In step S174, determination is made if the single mode is set up. If there is one, the process goes to Step S175 and, otherwise, to Step S176.

In Step S175, the color mode printing temperature is set up.

In Step S176, the position where the image forming unit is made valid is read out.

In step S177, the single color mode printing temperature is set up.

In Step S178, determination is made if the printing is completed. If the printing is completed, the process goes back to Step S171 and, otherwise, to Step S179.

In Step S179, on/off control of the fixer 63 is made and the process goes back to Step S178.

In Step S180, the stand-by temperature is set up.

In Step S181, determination is made if there is a printing request. If there is one, the process goes to Step S172 and, otherwise, to Step S182.

In Step S182, determination is made if the stand-by temperature holding time elapsed. If the time elapsed, the process goes to Step S184 and, otherwise, to Step 183.

In Step S183, on/off control of the fixer 63 is made and the process goes back to Step S181.

In Step S184, the fixer 63 is turned off and the process is terminated.

Figure 27:
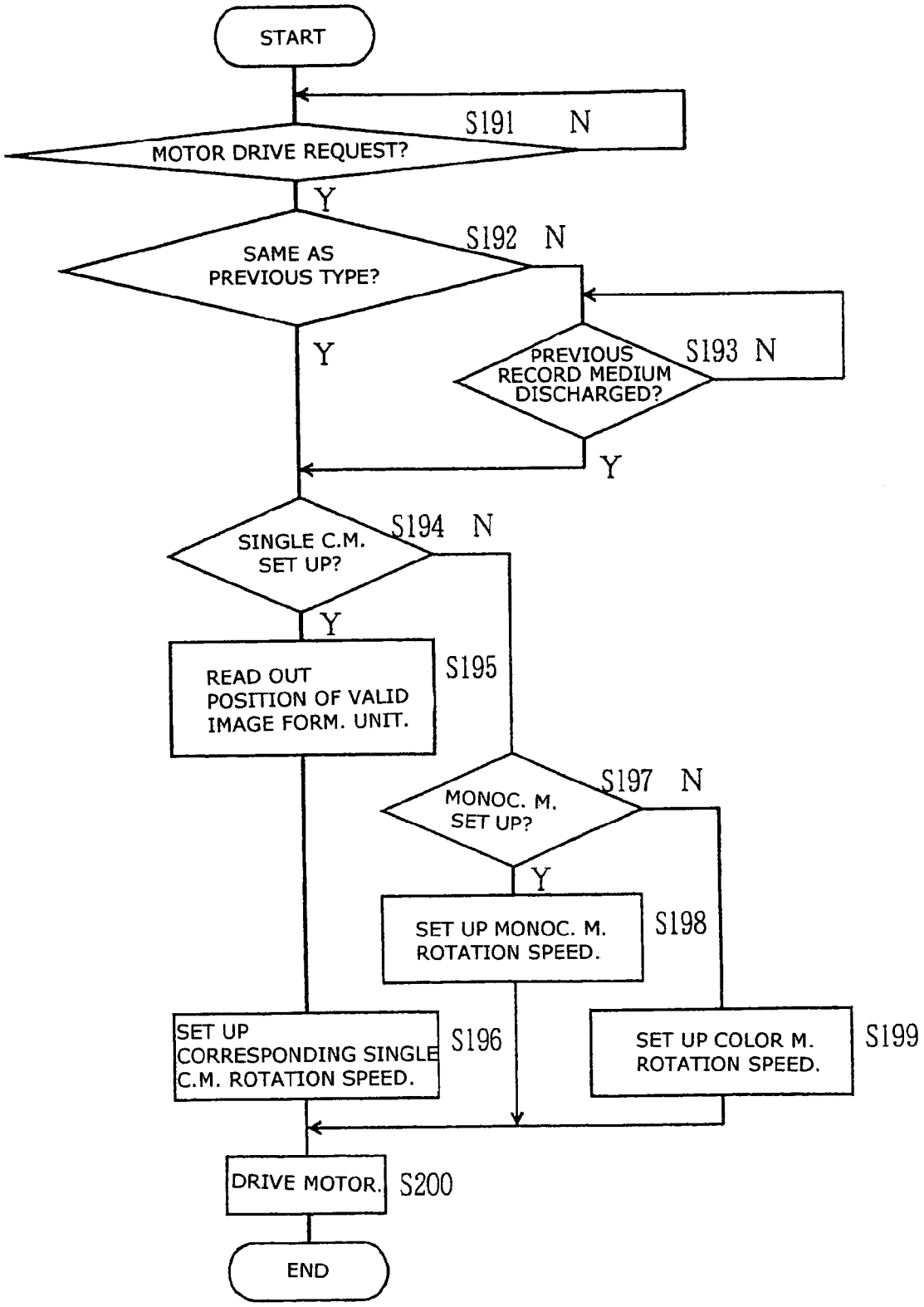
FIG. 27 is a flow chart showing a motor control process according to the fourth embodiment.

The motor control process will be described with reference to FIG. 27. The motor control section of the motor control unit 120 stands by for notification of a motor drive request from the state monitor 118 (FIG. 24). If the motor drive request is notified, the motor control section determines the type (color, monochrome, or single color mode) of the motor drive request. Then, it determines if the type notified is the same as that of the previous motor drive request. If the type is different from the previous one, the motor control section stands by until the previous recording medium S (FIG. 1) is discharged. If the type is the same as the previous one, it immediately determines if the single color mode is set up. If the type is different from the previous one, when the previous recording medium S is discharged, the motor control section determines if the single color mode is set up. If such a mode is set up, the motor control section reads out the position where the image forming unit is made valid and the corresponding single color mode motor control information from the motor speed information buffer 151. The single color mode motor control information is the motor control information at the position of the valid image forming unit among the image forming unit positions 1–3. Then, it sets the corresponding single color mode motor control information as a motor control parameter to set the single color mode rotation speed.

If there is no single color mode set up, the motor control section determines if the monochrome mode is set up. If there is the monochrome mode set up, it takes out the monochrome mode motor control information from the motor control information and sets it as a motor control parameter to set the monochrome mode rotation speed. If there is no monochrome mode set up, it takes out the color mode motor control information from the motor control information and sets it as a motor control parameter to set the color mode rotation speed. Then, based on the rotation speed, it drives motors, such as the hopping motor 125 and the transfer motor 126, to change the transfer speed of the recording medium S.

Thus, when the single color mode is set up, the printing temperature is set as a set temperature corresponding to the color selected in the single color mode and the transfer speed of the recording medium is set up corresponding to the printing temperature. As a result, the image forming speed and through-put can be improved.

Reference is made to the flow chart.

In Step S191, if a motor drive request is notified, the process goes to Step S192.

In step S192, determination is made if the type is the same as that of the previous motor drive request. If it is the same type, the process goes to Step S194 and, otherwise, to Step S193.

In Step S193, if the previous recording medium S is discharged, the process goes to Step S194.

In Step S194, determination is made if the single color mode is set up. If there is such a mode set up, the process goes to Step S195 and, otherwise, to Step S197.

In Step S195, the position where the image forming unit is made valid is read out.

In Step S196, the corresponding single mode rotation speed is set up.

In Step S197, determination is made if the monochrome mode is set up. If there is one set up, the process goes to Step S198 and, otherwise, to Step S199.

In Step S198, the monochrome mode rotation speed is set up.

In Step S199, the color mode rotation speed is set up.

In Step S200, the motor is driven and the process is terminated.

Figure 28:
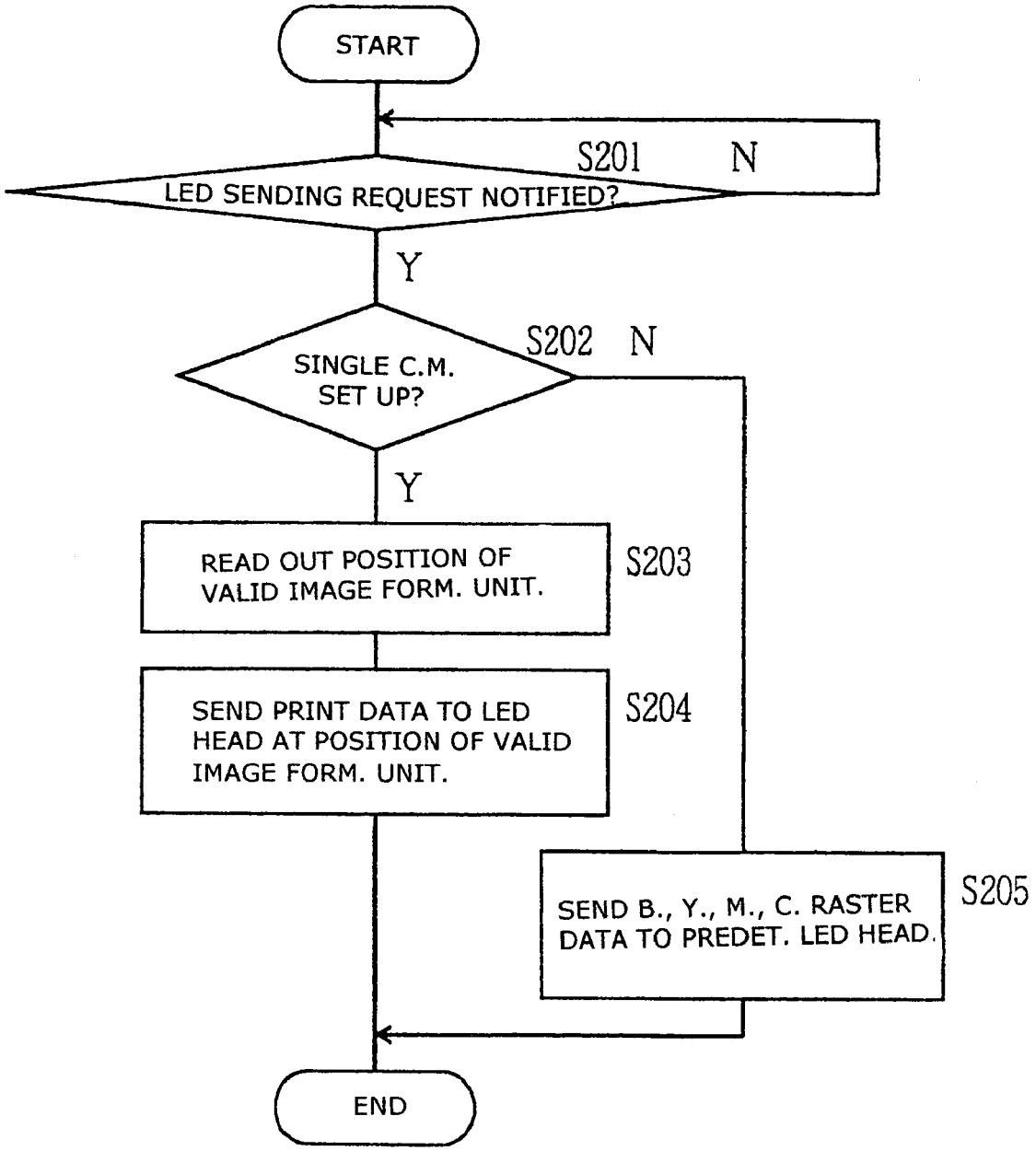
FIG. 28 is a flow chart showing a raster data sending process according to the fourth embodiment.

The raster data sending process will be described with reference to FIG. 28. The raster data sending section of the raster data sending unit 111 stands by for notification of an LED sending request from the printing control starting unit 110 (FIG. 24). Upon notification of such a request, it determines if the single color mode is set up. If such a mode is set up, it reads out the position of the image forming unit that has been made valid. Then, it sends a printing data to the LED head at the position of the valid image forming unit. If the single color mode is not set up, it sends to the LED head 13Bk the black raster data stored in the raster buffer 109. Then, it sends the yellow, magenta, and cyan raster data to the respective LED heads 13Y, 13M, and 13C.

Reference is made to the flow chart.

In Step S201, if an LED sending request is notified, the process goes to Step S202.

In Step S202, determination is made if the single mode is set up. If such a mode is set up, the process goes to Step S203 and, otherwise, to Step S205.

In Step S203, the position of the valid image forming unit is read out.

In Step S204, the printing data is sent to the LED head at the position of the valid image forming unit and the process is terminated.

In Step S205, the black, yellow, magenta, and cyan printing data is sent to the respective LED heads 13Bk, 13Y, 13M, and 13C.

Figure 29:
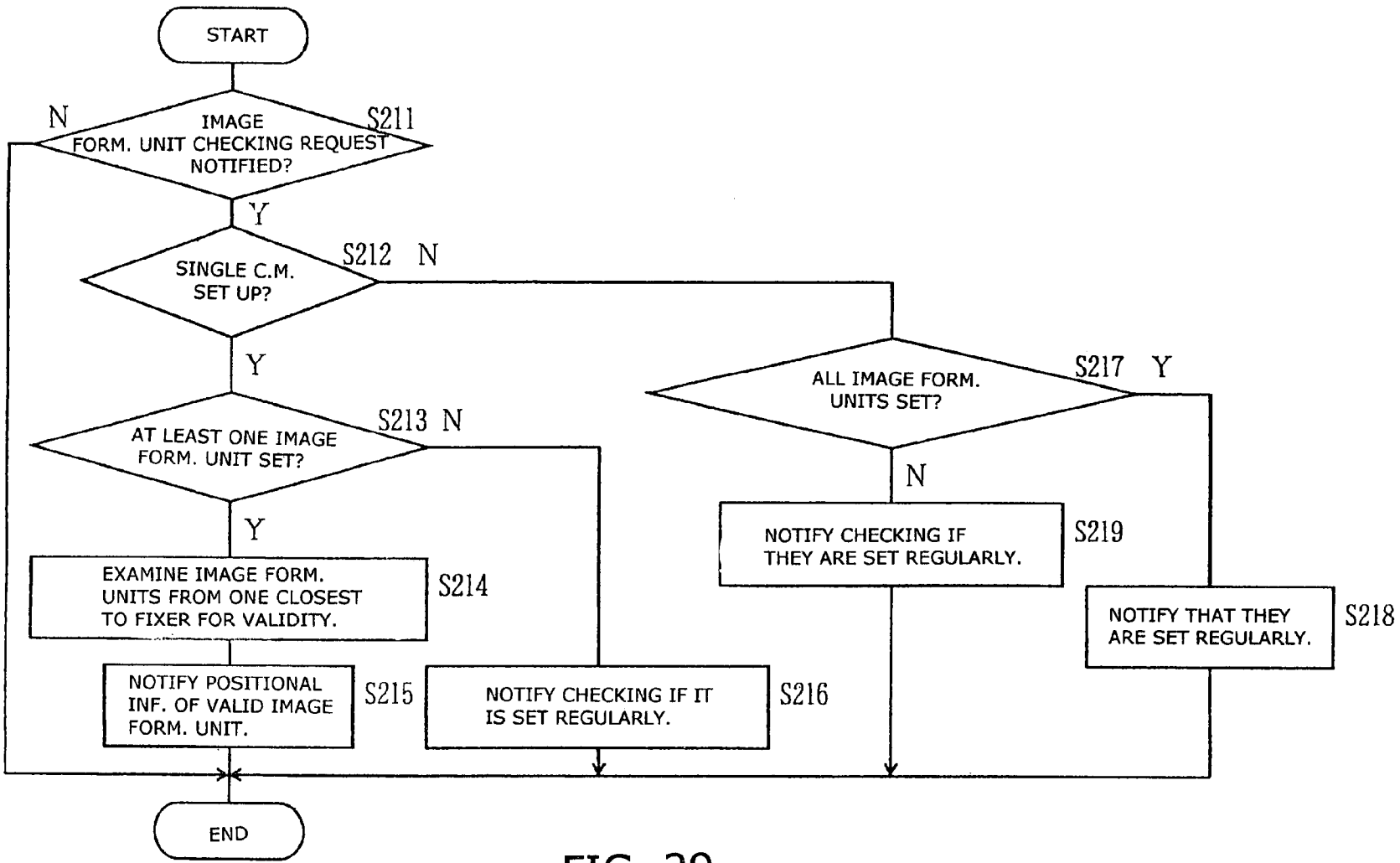
FIG. 29 is a flow chart showing an image forming unit monitoring process according to the fourth embodiment.

The image forming unit state monitoring process will be described with reference to FIG. 29. The image forming unit state monitoring section of the image forming unit state monitor 123 determines if the image forming unit checking request is notified. If such notification is made, it determines if the single color mode is set up. If such a mode is set up, it determines if at least one of the black, yellow, magenta, and cyan image forming units R1–R4 (FIG. 1) is set. If at least one of such units is set up, it examines the units in order from the one closest to the fixer 63 to determine if they are valid. Then, it notifies the operator of the position information about the valid image forming unit.

If none of the image forming units R1–R4 is set, it notifies the operator to check if the image forming unit is set regularly. If the single mode is not set, it determines if all of the image forming units R1–R4 are set. If all are set, it notifies the state monitor 118 that all the image forming units R1–R4 are set regularly. If any image forming unit is not set, it notifies the operator to check if the image forming units are set regularly.

Thus, where the single color mode is set up, the same color image forming unit can be set so that when the predetermined image forming unit is not available for the toner empty, etc., another image forming unit is used automatically for printing. As a result, it is possible to continue printing without replacing the image forming unit or the tone cartridge. Also, it is possible to raise not only the single color mode set temperature according to the position where the image forming unit is set but also the motor rotation speed, which in turn increases the image forming speed and through-put.

Reference is made to the flow chart.

In Step S211, determination is made if an image forming unit checking unit is notified. If such notification is made, the process goes to Step S212 and, otherwise, is terminated.

In Step S212, determination is made if the single color mode is set up. If such a mode is set up, the process goes to Step S213 and, otherwise, to Step S217.

In Step S213, determination is made if at least one image forming unit is set. If at least one such unit is set, the process goes to Step S214 and, otherwise, to Step S216.

In Step S214, the image forming units are examined from the one closest to the fixer 63 to determine if they are valid.

In Step S215, the positional information about the valid image forming unit is notified and the process is terminated.

In Step S216, notification is made to check if the units are set regularly and the process is terminated.

In Step S217, determination is made if all of the image forming units R1–R4 are set. If all of them are set, the process goes to Step S218 and, otherwise, to Step S219.

In Step S218, notification is made that the units are set regularly and the process is terminated.

In Step S219, notification is made to check if the units are set regularly and the process is terminated.

Alternatively, the toner image on the photosensitive drums 16Bk, 16Y, 16M, and 16C may be transfer to an intermediate transfer medium and then to the recording medium S. A variety of modifications to the invention may be made within the sprit of the invention and such modifications may fall in the protective scope of the claims.

As has been described above, according to the invention, there is provided an image forming apparatus comprising at least one image forming unit for a toner image on an image carrying body, a transfer unit opposed to the image carrying body for transferring the toner image to a recording medium, a fixing unit for fixing the transfer image onto the recording medium, and a temperature control unit for determining if the image forming unit is set and, based on the determination, changing the temperature set for the fixing unit.

If the image forming unit closer to the fixing unit than the predetermined image forming unit is not set, the temperature for the fixing unit is set so high that the warming-up time can be shortened when there is a next printing request in the stand-by state. As a result, the image forming speed and through-put can be improved.

The invention claimed is:

1. An image forming apparatus comprising:

at least one image forming unit for forming an image in one color or a plurality of image forming units for forming images in a plurality of colors;

a transfer unit for transferring said image onto a medium;

a fixing unit for fixing said image on said medium; and a fixing control unit for setting a temperature of said fixing unit to a first temperature when the at least one image forming unit or the plurality of the image forming units is arranged at a first arrangement for forming the image in a first color, and for setting the temperature of the fixing unit to a second temperature different from the first temperature when the one image forming unit or the plurality of the image forming units is arranged at a second arrangement for forming the image in a second color different from the first color.

2. The image forming apparatus according to claim 1, wherein said fixing control unit comprises:

a temperature detecting section for detecting the temperature of said fixing unit;

an image forming unit detecting section for detecting one of the first arrangement and the second arrangement;

a control temperature setting section for setting a control temperature based on a detection result of said image forming unit detection section; and a fixing temperature control section for controlling the temperature of said fixing unit based on detection results of said control temperature setting section and said temperature detecting section.

3. The image forming apparatus according to claim 2, wherein said plurality of the image forming units includes a first image forming unit and a second image forming unit both arranged such that a first distance between the first image forming unit and said fixing unit is smaller than a second distance between the second image forming unit and said fixing unit; and said control temperature setting section sets up a first control temperature if said image forming unit detecting unit detects that said first image forming unit is set and a second control temperature if said image forming unit detecting unit detects that said first image forming unit is not set and said second image forming unit is set, said second control temperature being higher than said first control temperature.

4. The image forming apparatus according to claim 2, wherein said at least one image forming unit or each of said plurality of the image forming units comprises a developing agent adhering section for adhering a developing agent to said medium;

said fixing unit includes a heat fixing section for applying heat to the developing agent on said medium to fuse and fixing it onto said medium; and said control temperature setting section sets a high control temperature of said fixing unit if said image forming unit detecting section determines that the at least one image forming unit or the plurality of the image forming units does not include an image forming unit close to said fixing unit.

5. The image forming apparatus according to claim 2, wherein said control temperature setting section sets said set temperature to a stand-by temperature where no printing is made.

6. The image forming apparatus according to claim 2, wherein said at least one image forming unit or said plurality of the image forming units transports the medium at a speed according to said set temperature.

7. An image forming apparatus comprising:

at least one image forming unit for forming an image;

a transfer unit for transferring said image onto a medium;

a fixing unit for said image on said medium;

an input section for inputting information if said at least one image forming unit is used; and a fixing control unit for controlling a temperature of said fixing unit based on the information input into said input section such that the temperature of the fixing device becomes higher when the one image forming unit capable of being located close to the fixing unit is not used than when the one image forming unit is used.

8. The image forming apparatus according to claim 7, wherein said input section includes a selection portion for selecting the at least one image forming unit.

9. The image forming apparatus according to claim 7, wherein said fixing control unit sets the temperature to a stand-by temperature where no printing is made.

10. The image forming apparatus according to claim 7, which further comprises a medium transfer control unit for controlling a transfer speed of said medium according to said temperature.

11. The image forming apparatus according to claim 7, wherein said input unit inputs information about limited printing where the at least one image forming unit is not used; and said fixing control unit controls a stand-by temperature of said fixing unit based on said limited printing information.

12. The image forming apparatus according to claim 11, which further comprises a medium transfer control unit for controlling a transfer speed of said medium according to said stand-by temperature.

13. An image forming apparatus for forming an image on a medium, comprising:

a first image forming unit arranged at a first position for forming the image in monochrome;

a second image forming unit arranged at a second position for forming the image in a color;

a transfer unit for transferring the image to the medium;

a fixing unit arranged at a third position closer to the second position than the first position for fixing the image on the medium; and a fixing control unit for setting a temperature of the fixing unit to a first temperature when the first image forming unit forms the image and the second image forming unit does not form the image, and for setting the temperature of the fixing unit to a second temperature lower than the first temperature when the first image forming unit and the second image forming unit form the image.

14. The image forming apparatus according to claim 13, wherein said fixing control unit comprises:

a temperature detecting section for detecting the temperature of the fixing unit;

an image forming unit detecting section for detecting the first image forming unit and the second image forming unit;

a control temperature setting section for setting a control temperature based on a detection result of the image forming unit detection section; and a fixing temperature control section for controlling the temperature of the fixing unit based on results of the control temperature setting section and the temperature detecting section.

15. The image forming apparatus according to claim 13, wherein said second image forming unit is arranged to be detachable.

16. The image forming apparatus according to claim 13, wherein said second image forming unit includes a plurality of sub-units arranged along a direction that the medium is transported for printing the image in different colors.

* * * * *